US009305503B2

(12) United States Patent
Wu et al.

(10) Patent No.: US 9,305,503 B2
(45) Date of Patent: Apr. 5, 2016

(54) DISPLAY PANEL WITH PRE-CHARGING OPERATIONS, AND METHOD FOR DRIVING THE SAME

(71) Applicant: AU Optronics Corporation, Hsin-Chu (TW)

(72) Inventors: Meng-Ju Wu, Hsin-Chu (TW); Chun-Fan Chung, Hsin-Chu (TW); Yu-Hsi Ho, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 0 days.

(21) Appl. No.: 14/717,039

(22) Filed: May 20, 2015

(65) Prior Publication Data

US 2015/0255027 A1 Sep. 10, 2015

Related U.S. Application Data

(62) Division of application No. 13/446,007, filed on Apr. 13, 2012, now Pat. No. 9,070,342.

(30) Foreign Application Priority Data

Nov. 18, 2011 (TW) ..... 100142368 A

(51) Int. Cl.
*G09G 3/36* (2006.01)

(52) U.S. Cl.
CPC ..... *G09G 3/3614* (2013.01); *G09G 3/3685* (2013.01); *G09G 3/3688* (2013.01); *G09G 2310/027* (2013.01); *G09G 2310/0248* (2013.01); *G09G 2310/0289* (2013.01); *G09G 2310/0291* (2013.01); *G09G 2310/0294* (2013.01); *G09G 2310/0297* (2013.01); *G09G 2320/103* (2013.01)

(58) Field of Classification Search
CPC .. G09G 3/3688; G09G 3/3614; G09G 3/3685
USPC ..... 345/98, 212
See application file for complete search history.

(56) References Cited

U.S. PATENT DOCUMENTS

| | | | | |
|---|---|---|---|---|
| 6,529,180 | B1 | 3/2003 | Ito et al. | |
| 7,119,781 | B2 | 10/2006 | Yu | |
| 7,773,079 | B2 | 8/2010 | Tsao et al. | |
| 2002/0047820 | A1 | 4/2002 | Ha | |
| 2008/0100603 | A1 * | 5/2008 | Matsuda | G09G 3/3688 345/205 |
| 2009/0009498 | A1 | 1/2009 | Nishimura | |
| 2010/0321412 | A1 * | 12/2010 | Weng | G09G 3/3688 345/690 |

FOREIGN PATENT DOCUMENTS

CN 101826311 9/2010

* cited by examiner

*Primary Examiner* — Kwang-Su Yang
(74) *Attorney, Agent, or Firm* — WPAT, PC; Justin King

(57) ABSTRACT

A display panel includes a switch control circuit, a first pre-charge switch circuit and a second pre-charge switch circuit. The switch control circuit is used for comparing the most significant bits (MSBs) of data signals to generate switch control signals for controlling the first and second pre-charge switch circuits, such that data lines are pre-charged through the first and second pre-charge switch circuits respectively. A method for driving a display panel is also provided herein.

15 Claims, 15 Drawing Sheets

DISPLAY PANEL WITH PRE-CHARGING OPERATIONS, AND METHOD FOR DRIVING THE SAME

RELATED APPLICATIONS

The present application is a division of U.S. application Ser. No. 13/446,007, filed Apr. 13, 2012, which claims priority to Taiwan Patent Application Serial Number 100142368, filed Nov. 18, 2011, the disclosure of which is hereby incorporated by reference herein in its entirety.

BACKGROUND

1. Technical Field

The present disclosure relates to a display panel. More particularly, the present disclosure relates to a driving circuit in the display panel.

2. Description of Related Art

Recently, due to the features of high-quality display capability and low power consumption, a liquid crystal display (LCD) has been popularly used as a displaying device.

A LCD panel includes a plurality of liquid crystal cells and a plurality of pixel elements, wherein each pixel element has a corresponding LCD unit. It has been known that, if a liquid crystal layer in the LCD unit has been applied with high voltage for a long time, the light transmittance properties of liquid crystal molecules therein are likely to have changes, and such changes are likely to cause unrecoverable damages to the LCD panel. Hence, polarities of the voltage signals applied to the LCD unit are continuously changed to prevent the liquid crystal molecules from being damaged by the persistent high voltage. The aforementioned polarity inversion manner includes a dot inversion and a line inversion.

When the voltage polarity of the LCD panel is driven to be reversed, the current consumed by a source driver is maximum, which is at the moment which the LCD has a maximum load. In order to resolve the aforementioned problem, a conventional LCD adopts a charging sharing method to reduce power consumption when the voltage polarity thereof is reversed, wherein charges are redistributed before a data driver outputs a data signal, thereby saving dynamic current to be consumed.

However, since, in general, the aforementioned charge sharing method is performed only when the polarity is reversed, in order to save power consumption under the situation of higher frame rate, a specific polarity inversion method, such as a column inversion, is generally adopted. Thus, for some certain pixel patterns requiring continuous transitions, such as a H-stripe pattern, a sub-checker pattern, a pixel checker pattern, etc., the aforementioned specific polarity inversion method can be adopted to have the charge sharing effect. In other words, some certain pixel patterns requiring continuous transitions still need to consume quite a large transition current, thus resulting in a rising operation temperature of the LCD, leading to likely abnormalities of the elements therein.

SUMMARY

Hence, a technical aspect of the present disclosure is to provide a display panel for lowering the transition current required to be consumed by pixel patterns in continuous transition.

In accordance with an embodiment of the present disclosure, a display panel includes a plurality of data lines and a source driver. The data lines include a first data line and a second data line adjacent to the first data line. The source driver is coupled to the data lines and includes a first latching circuit, a second latching circuit, a transmission switch circuit, a switch control circuit, a first pre-charge switch and a second pre-charge switch.

The first latching circuit is used for sequentially sampling input data signals and successively generating a first former sample data signal and a first latter sample data signal, wherein the first latching circuit outputs the first former sample data signal when the first latter sample data signal is generated. The second latching circuit is used for sequentially sampling the input data signals and successively generating a second former sample data signal and a second latter sample data signal, wherein the second latching circuit outputs the second former sample data signal when the second latter sample data signal is generated.

The transmission switch circuit is coupled to the first data line and the second data line, wherein the transmission switch circuit is activated in accordance with a polarity signal and a control signal, such that a first output data signal corresponding to the first former sample data signal and a second output data signal corresponding to the second former sample data signal are transmitted through the transmission switch circuit.

The switch control circuit is coupled to the first latching circuit and the second latching circuit for comparing the most significant bit (MSB) of the first former sample data signal with the MSB of the first latter sample data signal and comparing the MSB of the second former sample data signal with the MSB of the second latter sample data signal, thereby generating a first switch control signal and a second switch control signal.

The first pre-charge switch circuit is coupled to the first data line and the switch control circuit, wherein the first pre-charge switch circuit is activated in accordance with the first switch control signal, the polarity signal and the control signal when the transmission switch circuit is deactivated, such that the first data line is pre-charged by one of a first pre-charge voltage and a second pre-charge voltage through the first pre-charge switch circuit. The second pre-charge switch circuit is coupled to the second data line and the switch control circuit, wherein the second pre-charge switch circuit is activated in accordance with the second switch control signal, the polarity signal and the control signal when the transmission switch circuit is deactivated, such that the second data line is pre-charged by the other of the first pre-charge voltage and the second pre-charge voltage through the second pre-charge switch circuit.

Another technical aspect of the present disclosure is to provide a method for driving a display panel for lowering an operation temperature of a source driver. The display panel applicable to the method includes a plurality of data lines and the source driver used for driving the data lines. The data lines include a first data line and a second data line adjacent to the first data line, and the source driver includes a first latching circuit, a second latching circuit and a transmission switch circuit, wherein the first latching circuit is used for sequentially sampling input data signals and successively generating a first former sample data signal and a first latter sample data signal, and the second latching circuit is used for sequentially sampling the input data signals and successively generating a second former sample data signal and a second latter sample data signal, and the transmission switch circuit is activated in accordance with a polarity signal and a control signal, thereby transmitting a first output data signal corresponding to the first former sample data signal and a second output data signal corresponding to the second former sample data signal.

The aforementioned method includes: deactivating the transmission switch circuit in accordance with the polarity signal and the control signal; under a situation at which the MSB of the first former sample data signal is different from the MSB of the first latter sample data signal, pre-charging the first data line by using one of a first pre-charge voltage and a second pre-charge voltage during a period in which the control signal is at a high level; and under a situation at which the MSB of the second former sample data signal is different from the MSB of the second latter sample data signal, pre-charging the second data line by using the other of the first pre-charge voltage and the second pre-charge voltage during the period in which the control signal is at the high level.

According to the technical disclosure of the present disclosure, the aforementioned display panel and method for driving the display panel, the transition current required to be consumed can be reduced, and the power consumption required by the source driver can be reduced, and thus the operation temperature of the source driver can be lowered.

The present disclosure is to provide a brief description for one of ordinary skill in the art to have a basic understanding for the present disclosure. It is to be understood that both the foregoing general description and the latter detailed description are examples, and are intended to provide further explanation of the disclosure as claimed.

BRIEF DESCRIPTION OF THE DRAWINGS

These and other features, aspects, and advantages of the present disclosure will become better understood with regard to the latter description, appended claims, and accompanying drawings where:

DESCRIPTION OF THE PREFERRED EMBODIMENTS

The present disclosure will now be described more fully hereinafter with reference to the accompanying drawings, but exemplary embodiments provided are not used for limiting the scope covered by the present disclosure, and the description regarding the structural operation is not used for limiting the execution sequence of the present disclosure. Rather, the devices with equivalent functions generated from any structure reassembled by the elements of the present disclosure all fall within the scope covered by the present disclosure. Further, the drawings are merely used for explanation and are not scaled to the original size.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

Further, as used herein, "coupled" or "connected" shall generally means that two or more elements are in direct physical or electrical contact or in indirect physical or electrical contact, and "coupled" also means two or more elements interact with each other.

Figure 1:
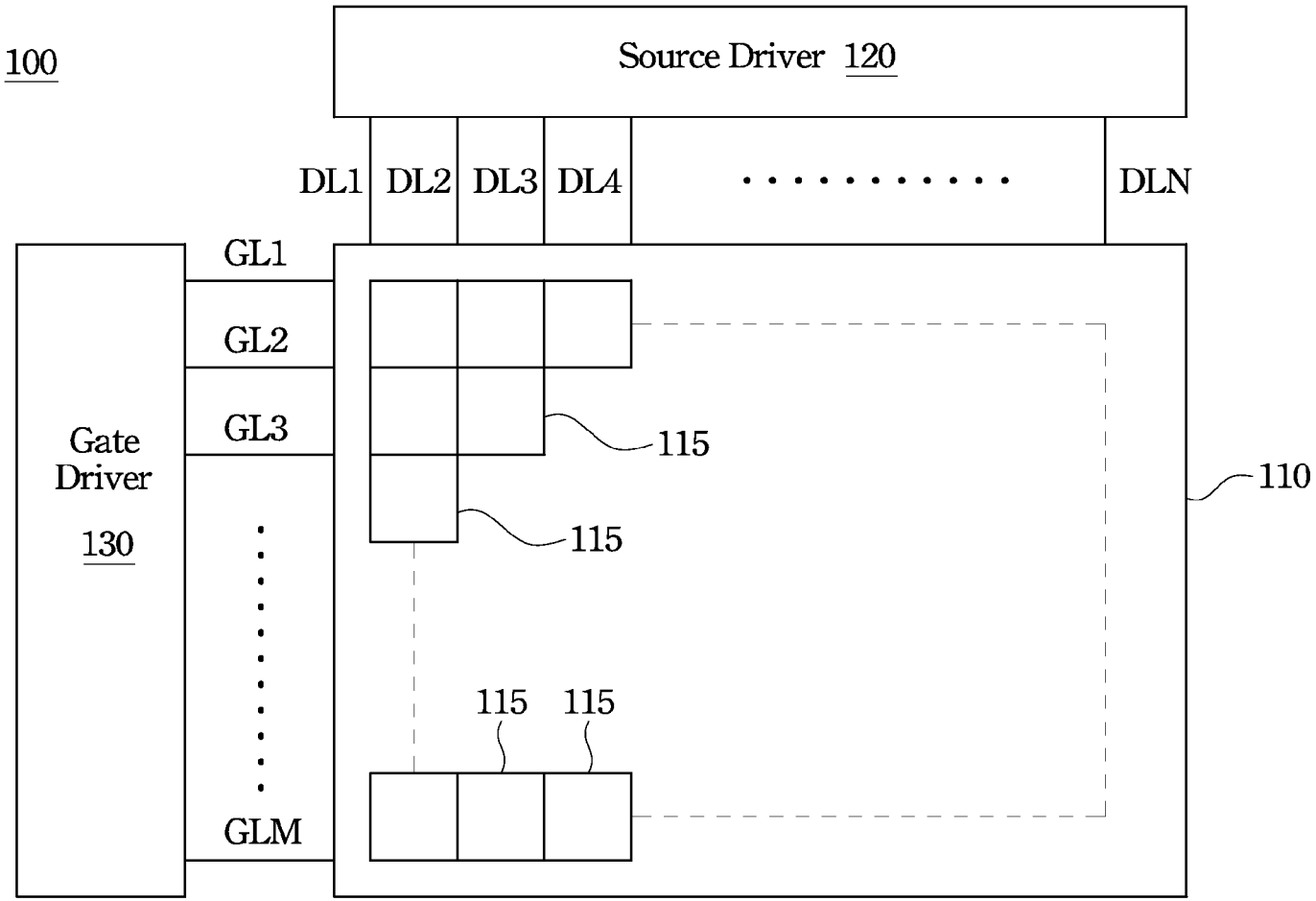
FIG. 1 is a schematic diagram view showing a display panel according to one embodiment of the present disclosure.

FIG. 1 is a schematic diagram view showing a display panel 100 according to one embodiment of the present disclosure. The display panel 100 includes an image display area 110, a source driver 120 and a gate driver 130. The image display area 110 includes an array formed by alternately arranging a plurality of data lines (such as N data lines D1-DN) and a plurality of gate lines (such as M gate lines G1-GM); and a plurality of display pixels 115 disposed in the aforementioned array. The source driver 120 is coupled to the data lines D1-DN, and is used for providing data signals to the image display areas through the data lines D1-DN. The gate driver 130 is coupled to the gate lines G1-GM, and is used for providing gate line signals to the image display areas through the gate lines G1-GM.

Figure 2:
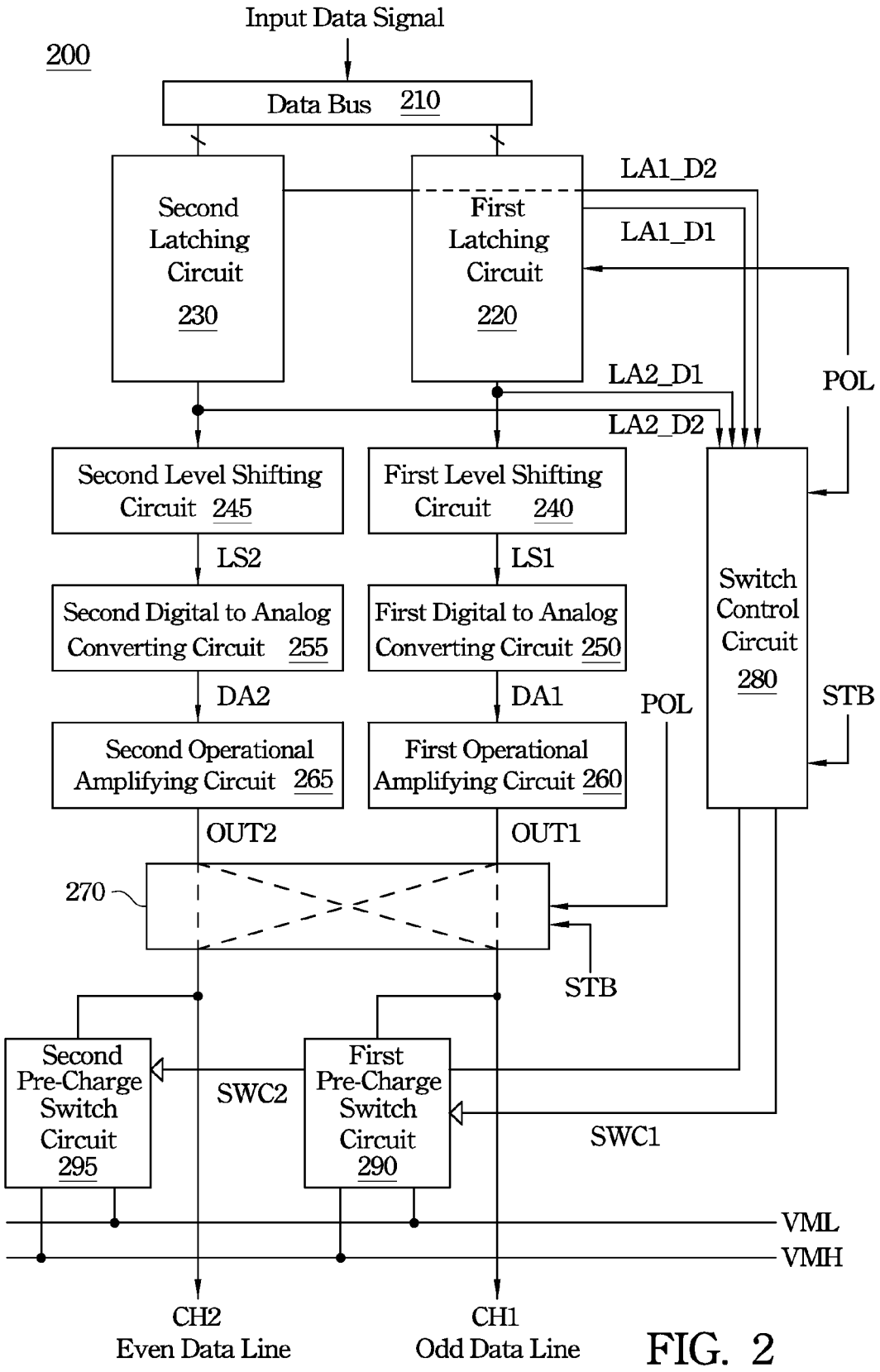
FIG. 2 is a schematic functional block diagram showing a source driver according to one embodiment of the present disclosure.

FIG. 2 is a schematic functional block diagram showing a source driver 200 according to one embodiment of the present disclosure. The source driver 200 is applicable the display panel as shown in FIG. 1, and includes a data bus 210, a first latching circuit 220, a second latching circuit 230, a transmission switch circuit 270, a switch control circuit 280, a first pre-charge switch circuit 290 and a second pre-charge switch circuit 295.

The first latching circuit 220 may receive input data signals via the data bus 210, and is used for sequentially sampling the input data signals to successively generate a first former sample data signal LA2_D1 and a first latter sample data signal LA1_D1, wherein, when the first latter sample data signal LA1_D1 is generated, the first latching circuit 220 outputs the first former sample data signal LA2_D1 which is converted to a first output data line signal OUT1 subsequently.

It is noted that the aforementioned first latching circuit 220 generating the first former sample data signal LA2_D1 and the first latter sample data signal LA1_D1 successively, mainly means that the first latching circuit 220 first samples an input data signal inputted earlier to generate the first former sample data signal LA2_D1, and then holds the first former sample data signal LA2_D1 and samples another input data signal inputted latter, and outputs the first former sample data signal LA2_D1 which is being held when the first latter sample data signal LA1_D1 is generated.

Secondly, the second latching circuit 230 may receive the input data signals via the data bus 210, and is used for sequentially sampling the input data signals to successively generate a second former sample data signal LA2_D2 and a second latter sample data signal LA1_D2, wherein, when the first latter sample data signal LA1_D2 is generated, the second latching circuit 230 outputs the second former sample data signal LA2_D2 which is converted to a second output data line signal OUT2 subsequently.

Similarly, the aforementioned second latching circuit 230 generating the second former sample data signal LA2_D2 and the second latter sample data signal LA1_D2 successively, mainly means that the second latching circuit 230 first samples an input data signal inputted earlier to generate the second former sample data signal LA2_D2, and then holds the second former sample data signal LA2_D2 and samples another input data signal inputted latter, and outputs the second former sample data signal LA2_D2 which is being held when the second latter sample data signal LA1_D2 is generated.

The transmission switch circuit 270 is electrically coupled to an odd data line and an even data line adjacent thereto, and is activated in accordance with a polarity signal POL and a control signal STB, such that the first output data line signal OUT1 corresponding to the first former sample data signal LA2_D1 and the second output data line signal OUT2 corresponding to the second former sample data signal LA2_D2 can be transmitted to the odd data line and the even data line through a channel CH1 and a channel CH2.

The switch control circuit 280 is electrically coupled to the first latching circuit 220 and the second latching circuit 230, and is used for comparing the most significant bit (MSB) of the first former sample data signal LA2_D1 with the MSB of the first latter sample data signal LA1_D1, and comparing the MSB of the second former sample data signal LA2_D2 with the MSB of the second latter sample data signal LA2_D1, thereby generating a first switch control signal SWC1 and a second switch control signal SWC2.

The first pre-charge switch circuit 290 is electrically coupled to the odd data line and the switch control circuit 280, and is activated in accordance with the first switch control signal SWC1, the polarity signal POL and the control signal STB when the transmission switch circuit 270 is deactivated, such that the odd data line is pre-charged by one of a first pre-charge voltage VMH and a second pre-charge voltage VML through the first pre-charge switch circuit 290.

In one embodiment, the first pre-charge voltage VMH can be greater than the second pre-charge voltage VML. In another embodiment, the first pre-charge voltage VMH can be about equal to the second pre-charge voltage VML. In other words, one of ordinary skill in the art may select proper voltages VMH and VML in accordance with actual needs.

The second pre-charge switch circuit 295 is electrically coupled to the even data line and the switch control circuit 280, wherein the second pre-charge switch circuit is activated in accordance with the second switch control signal SWC2, the polarity signal POL and the control signal STB when the transmission switch circuit 270 is deactivated, such that the even data line is pre-charged by the other of the first pre-charge voltage VMH and the second pre-charge voltage VML through the second pre-charge switch circuit 295.

In one embodiment, the source driver 200 further includes a first level shifting circuit 240, a second level shifting circuit 245, a first digital to analog converting circuit 250, a second digital to analog converting circuit 255, a first operational amplifying circuit 260 and a second operational amplifying circuit 265. The first level shifting circuit 240 is used for receiving the first former sample data signal LA2_D1 outputted by the first latching circuit 220 and outputting a first level shifted data signal LS1. The second level shifting circuit 245 is used for receiving the second former sample data signal LA2_D2 outputted by the second latching circuit 230 and outputting a second level shifted data signal LS2. The first digital to analog converting circuit 250 is used for converting the first level shifted data signal LS1 to a first analog signal DA1. The second digital to analog converting circuit 255 is used for converting the second level shifted data signal LS2 to a second analog signal DA2. The first operational amplifying circuit 260 is used for processing the first analog signal DA1 to generate the first output data signal OUT1. The second operational amplifying circuit 265 is used for processing the second analog signal DA2 to generate the second output data signal OUT2.

Figure 3:
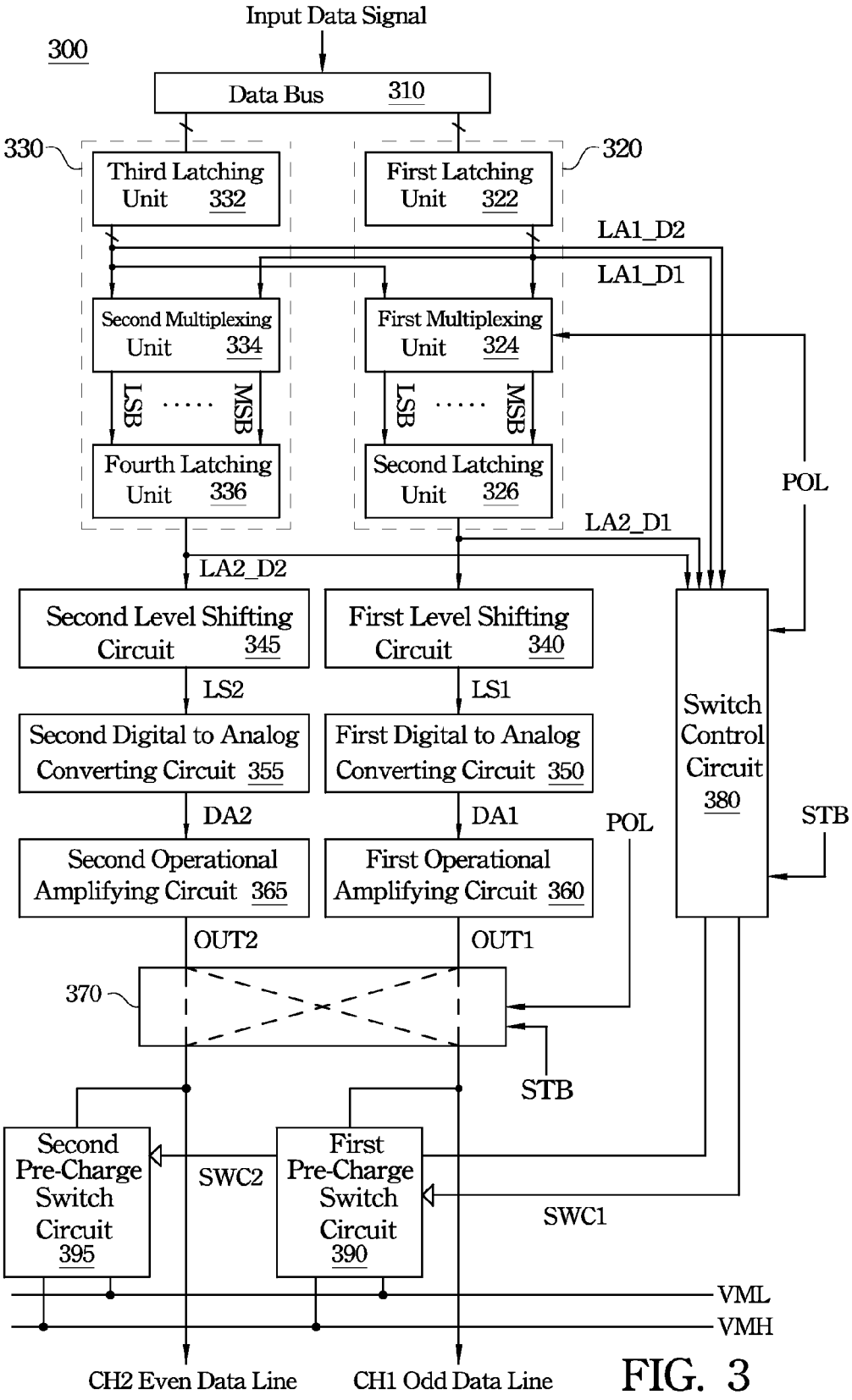
FIG. 3 is a schematic functional block diagram showing a source driver according to another embodiment of the present disclosure.

FIG. 3 is a schematic functional block diagram showing a source driver 300 according to another embodiment of the present disclosure. The source driver 300 is applicable to the display panel 100 as shown in FIG. 1, and includes a data bus 310, a first latching circuit 320, a second latching circuit 330, a transmission switch circuit 370, a switch control circuit 380, a first pre-charge switch circuit 390 and a second pre-charge switch circuit 395, wherein the coupling and operational relationships among the aforementioned circuits and the respective functions thereof are similar to the embodiment shown in FIG. 2, and thus are not repeated again herein.

In one embodiment, the source driver 300 further includes a first level shifting circuit 340, a second level shifting circuit 345, a first digital to analog converting circuit 350, a second digital to analog converting circuit 355, a first operational amplifying circuit 360 and a second operational amplifying circuit 365, wherein the coupling and operational relationships among the aforementioned circuits and the respective functions thereof are similar to the embodiment shown in FIG. 2, and thus are not repeated again herein.

In comparison with the embodiment shown in FIG. 2, in the present disclosure, the first latching circuit 320 further includes a first latching unit 322, a first multiplexing unit 324 and a second latching unit 326, the second latching circuit 330 further including a third latching unit 332, a second multiplexing unit 334 and a fourth latching unit 336. The first latching unit 322 and the third latching unit 332 are mainly used for sampling the input signals for outputting sampled data signals. The first multiplexing unit 324 and the second multiplexing unit 334 are mainly used for switching the sampled data signals. The second latching unit 326 and the fourth latching unit 336 are mainly used for holding the sampled data signals previously generated.

Specifically speaking, the first latching unit 322 is used for outputting the first latter sample data signal LA1_D1, and the first multiplexing unit 324 has a first input end and a second input end, wherein the first input end of the first multiplexing unit 324 is electrically coupled to an output end of the first latching unit 322, and the second input end thereof is electrically coupled to an output end of the third latching unit 332. The second latching unit 326 is electrically coupled to an output end of the first multiplexing unit 324 and an input end of the first level shifting circuit 340 for outputting the first former sample data signal LA2_D1 to the first level shifting circuit 340.

Secondly, the third latching unit 332 is used for outputting the second latter sample data signal LA1_D2. The second multiplexing unit 334 has a first input end and a second input end, wherein the first input end of the second multiplexing unit 334 is electrically coupled to an output end of the first latching unit 322, and the second input end thereof is electrically coupled to the output end of the third latching unit 332. The fourth latching unit 336 is electrically coupled to an output end of the second multiplexing unit 334 and an input end of the second level shifting circuit 345 for outputting the second former sample data signal LA2_D2 to the second level shifting circuit 345.

The first former sample data signal LA2_D1 may be a signal sampled from the input data signal which is outputted earlier from the data bus 310, and the first latter sample data signal LA1_D1 may be a signal sampled from the input data signal which is outputted later from the data bus 310. In operation, the second latching unit 326 receives the signal outputted from the first multiplexing unit 324 and thus holds the first former sample data signal LA2_D1. When the first latching unit 322 outputs the first latter sample data signal LA1_D1, the second latching unit 326 outputs the first former sample data signal LA2_D1 being held.

Similarly, the second former sample data signal LA2_D2 may be a signal sampled from the input data signal which is outputted earlier from the data bus 310, and the second latter sample data signal LA1_D2 may be a signal sampled from the input data signal which is outputted later from the data bus 310. In operation, the fourth latching unit 336 receives the signal outputted from the second multiplexing unit 334 and thus holds the first former sample data signal LA2_D2. When the third latching unit 332 outputs the second latter sample data signal LA1_D2, the fourth latching unit 336 outputs the second former sample data signal LA2_D2 being held.

The switch control circuit 380 is electrically coupled to the output ends of the first latching unit 322, the second latching unit 326, the third latching unit 332 and the fourth latching unit 336, and is used for comparing the most significant bits (MSBs) of the first former sample data signal LA2_D1, the first latter sample data signal LA1_D1, the second former sample data signal LA2_D2 and second latter sample data signal LA1_D2. In one embodiment, when the MSB of the first former sample data signal LA2_D1 is different from that of the first latter sample data signal LA1_D1, the switch control circuit 380 generates the first switch control signal SWC1. When the MSB of the second former sample data signal LA2_D2 is different from that of the second latter sample data signal LA1_D2, the switch control circuit 380 generates the second switch control signal SWC2.

Figure 4A:
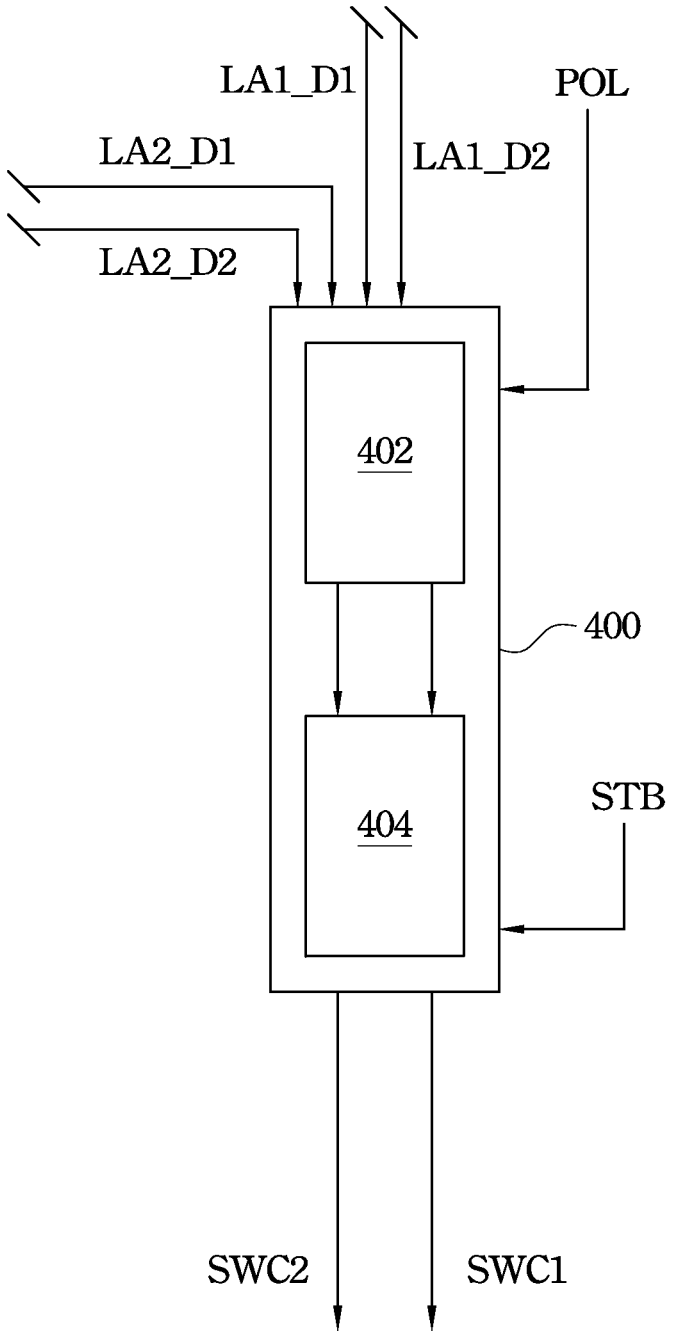
FIG. 4A is a schematic diagram view showing a switch control circuit according to one embodiment of the present disclosure.

FIG. 4A is a schematic diagram view showing a switch control circuit 400 according to one embodiment of the present disclosure. The switch control circuit 400 is applicable to the source driver as shown in FIG. 2 or FIG. 3. The switch control circuit 400 includes a comparing circuit 402 and a latch circuit 404, wherein the comparing circuit 402 processes the signals LA1_D1, LA2_D1, LA1_D2 and LA2_D2 in accordance the polarity signal POL, and transmits the processed signals to the latch circuit 404, and the latch circuit 404 outputs the switch control signals SWC1 and SWC2 in accordance with the behavior of the control signal STB.

Figure 4B:
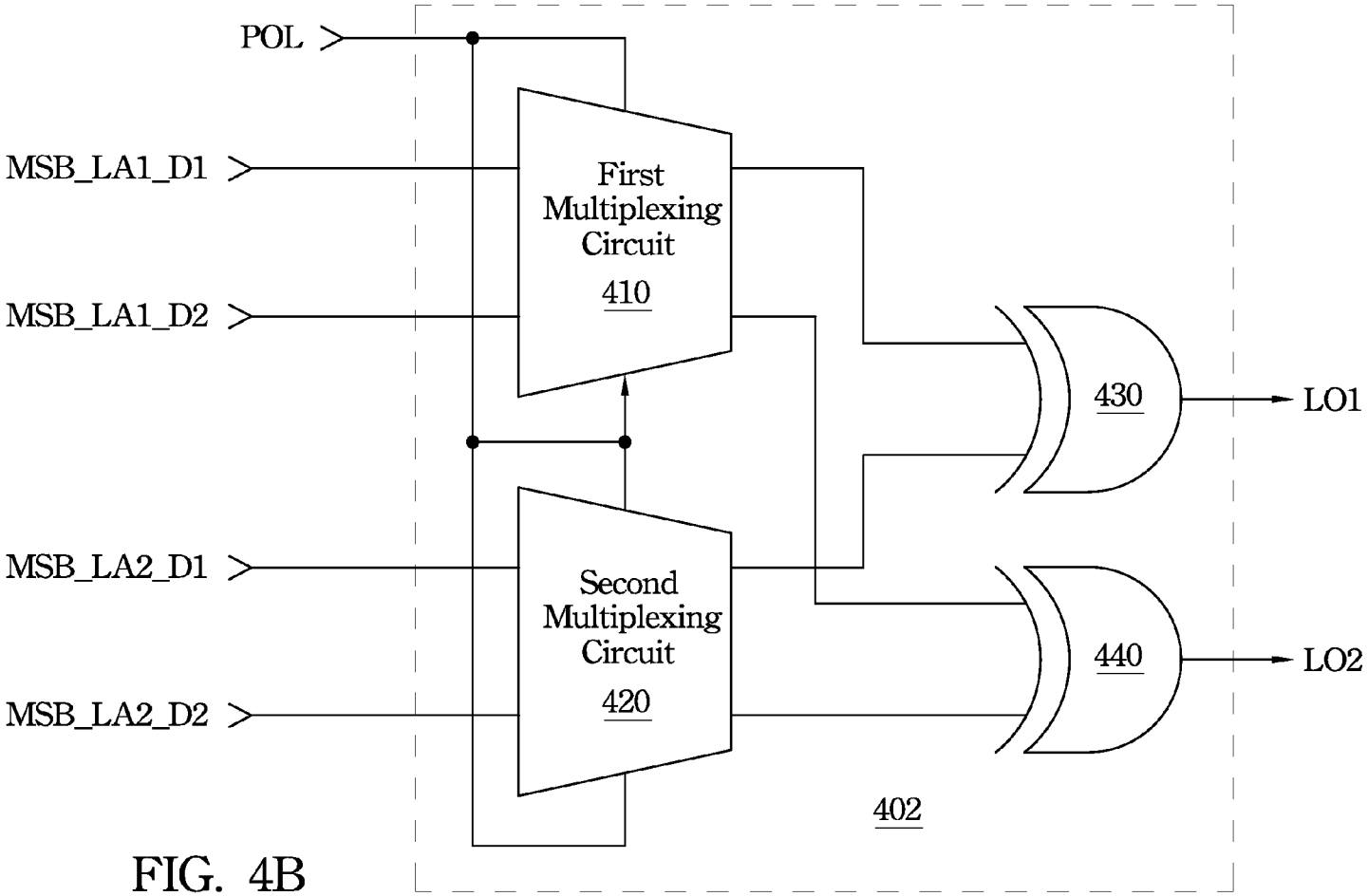
FIG. 4B is a schematic diagram view showing a comparing circuit shown in FIG. 4A according to one embodiment of the present disclosure.

FIG. 4B is a schematic diagram view showing the comparing circuit 402 shown in FIG. 4A according to one embodiment of the present disclosure. The comparing circuit 402 includes a first multiplexing circuit 410, a second multiplexing circuit 420, a first XOR gate 430 and a second XOR gate 440.

The first multiplexing circuit 410 has a first input end, a second input end, a first output end and a second output end, wherein the first input end of the first multiplexing circuit 410 is used for receiving the MSB MSB_LA1_D1 of the first latter sample data signal LA1_D1, and the second input end thereof is used for receiving the MSB MSB_LA1_D2 of the second latter sample data signal LA1_D2; The second multiplexing circuit 420 has a first input end, a second input end, a first output end and a second output end, wherein the first input end of the second multiplexing circuit 420 is used for receiving the MSB MSB_LA2_D1 of the first former sample data signal LA2_D1, and the second input end thereof is used for receiving the MSB MSB_LA2_D2 of the second former sample data signal LA2_D2.

The first XOR gate 430 has a first input end, a second input end and an output end, wherein the first input end of the first XOR gate 430 is coupled to the first output end of the first multiplexing circuit 410, and the second input end of the first XOR gate 430 is coupled to the first output end of the second multiplexing circuit 420, and the output end of the first XOR gate 430 is used for outputting a first comparison signal LO1.

The second XOR gate 440 has a first input end, a second input end and an output end, wherein the first input end of the second XOR gate 440 is coupled to the second output end of the first multiplexing circuit 410, and the second input end of the second XOR gate 440 is coupled to the second output end of the second multiplexing circuit 420, and the output end of the second XOR gate 440 is used for outputting a second comparison signal L02.

In operation, the first multiplexing circuit 410 is controlled by the polarity signal POL for accordingly switching and outputting the MSB MSB_LA1_D1 (or the MSB MSB_LA1_D2) to the first XOR gate 430 or the second XOR gate 440. Similarly, the second multiplexing circuit 420 is also controlled by the polarity signal POL for accordingly switching and outputting the MSB MSB_LA2_D1 (or the MSB MSB_LA2_D2) to the first XOR gate 430 or the second XOR gate 440. Thereafter, the first XOR gate 430 or the second XOR gate 440 performs comparison on the received MSBs and outputs the first comparison signal LO1 and the second comparison signal LO2 accordingly.

For example, under a situation that the first XOR gate 430 receives the MSB MSB_LA1_D1 and the MSB MSB_LA2_D1, when the first latter sample data signal LA1_D1 is different from the first former sample data signal LA2_D1 (i.e. data transition resulted from image switching), if the MSB MSB_LA1_D1 is "1" and the other MSB MSB_LA2_D1 is "0", the first comparison signal LO1 of logic "1" (high level) is generated after the first XOR gate 430 performs the XOR operation on those two signals.

Figure 4C:
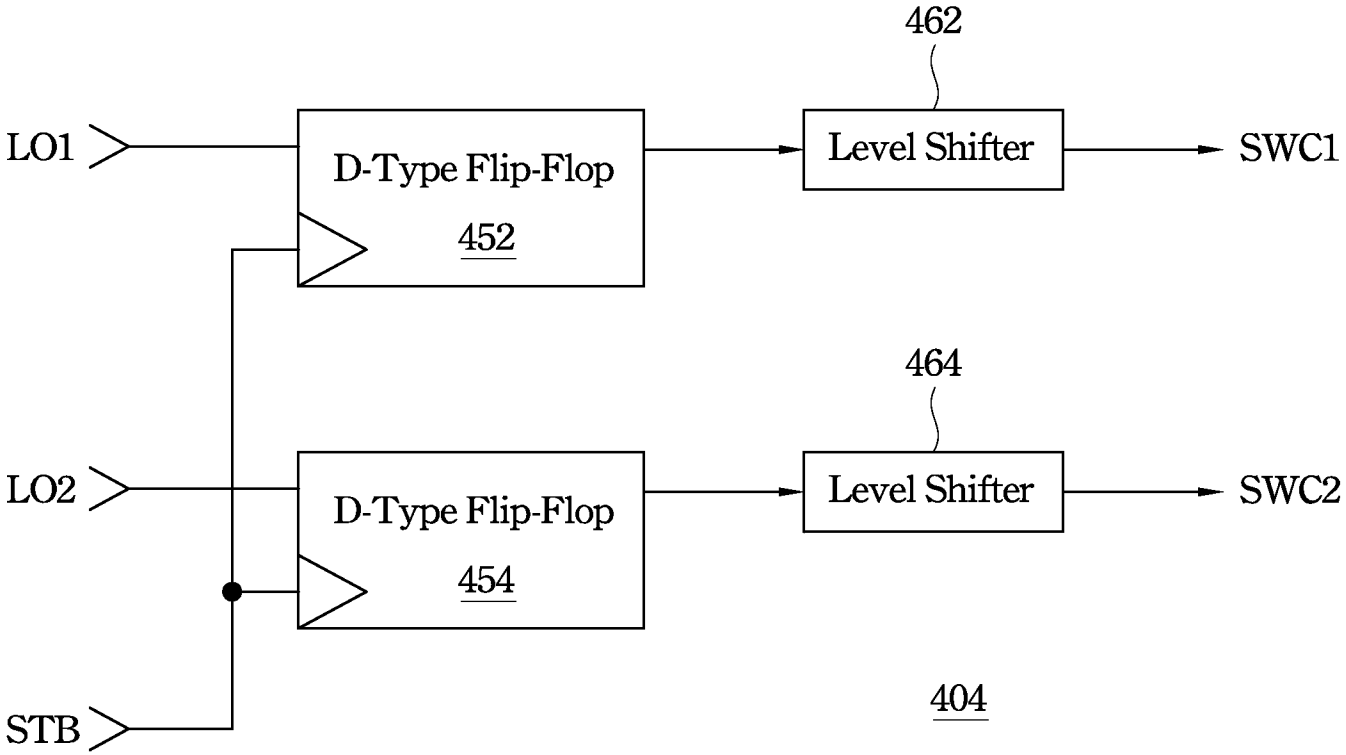
FIG. 4C is a schematic diagram view showing a latch circuit shown in FIG. 4A according to one embodiment of the present disclosure.

FIG. 4C is a schematic diagram view showing the latch circuit 404 shown in FIG. 4A according to one embodiment of the present disclosure. The latch circuit 404 includes two D-type flip-flops 452 and 454 and two level shifters 462 and 464. The D-type flip-flop 452 is used for receiving the first comparison signal LO1 outputted by the comparing circuit 402. After the D-type flip-flop 452 is triggered by the control signal STB, the first comparison signal LO1 is outputted to the level shifter 462 for processing. The level shifter 462 outputs the first switch control signal SWC1 to activate the first pre-charge switch circuit 290 in accordance with the first switch control signal SWC1, and the odd data line is pre-charged by the first pre-charge voltage VMH or the second pre-charge voltage VML through the first pre-charge switch circuit 290. The D-type flip-flop 454 is used for receiving the second comparison signal LO2 outputted by the comparing circuit 402. After the D-type flip-flop 454 is triggered by the control signal STB, the second comparison signal LO2 is outputted to the level shifter 464 for processing. The level shifter 464 outputs the second switch control signal SWC2 to activate the second pre-charge switch circuit 295 in accordance with the second switch control signal SWC2, and the even data line is pre-charged by the first pre-charge voltage VMH or the second pre-charge voltage VML through the second pre-charge switch circuit 295.

Figure 5A:
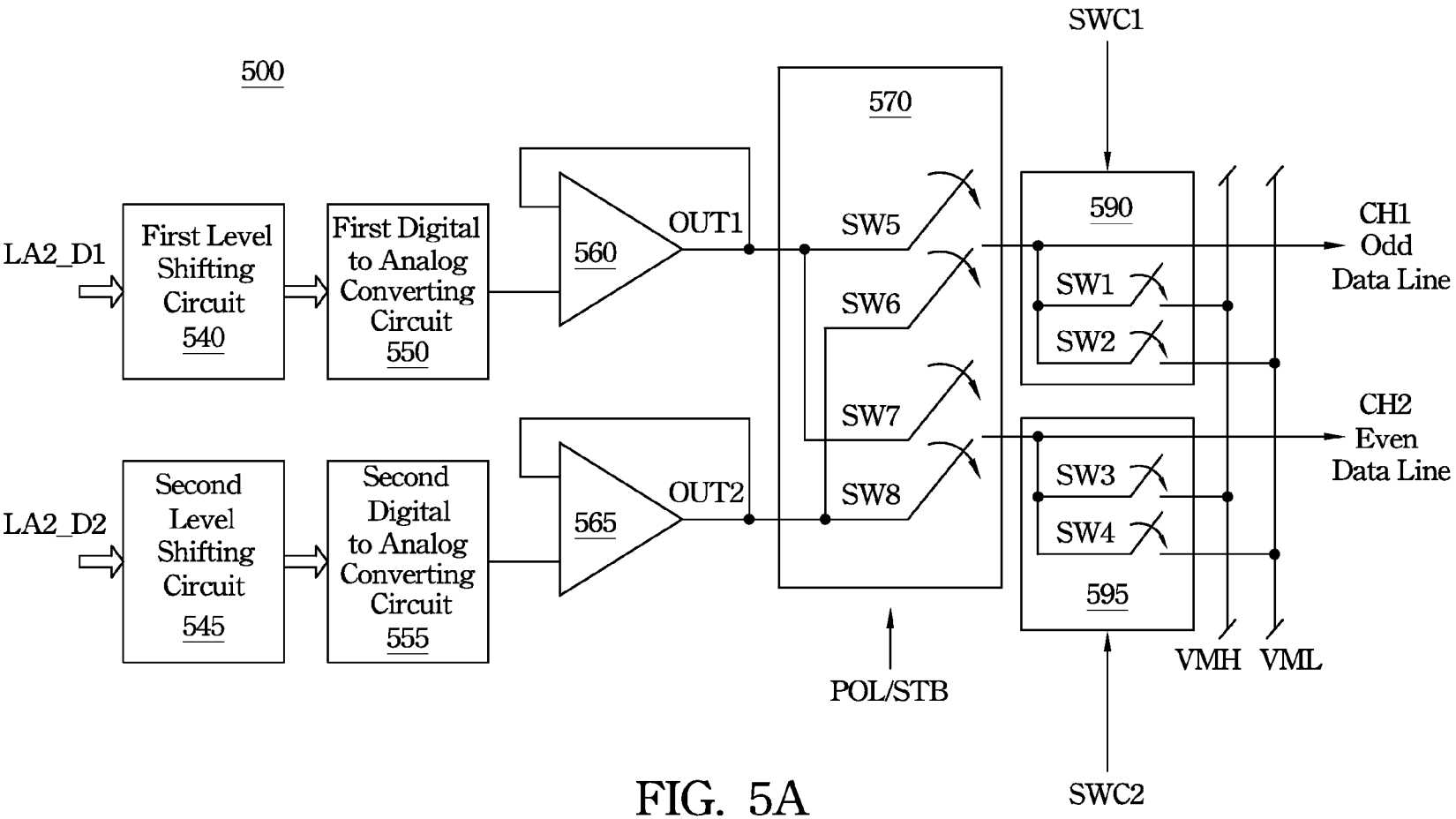
FIG. 5A is a schematic functional block diagram showing a source driver according to another embodiment of the present disclosure.

FIG. 5A is a schematic functional block diagram showing a source driver 500 according to another embodiment of the present disclosure. The source driver 500 is applicable to the display panel 100 as shown in FIG. 1. The source driver 500 includes two level shifting circuits 540 and 545, two digital to analog converting circuits 550 and 555, two operational amplifying circuits 560 and 565, a transmission switch circuit 570 and first and second pre-charge switch circuits 590 and 595. The coupling and operational relationships among the level shifting circuits 540 and 545, the digital to analog converting circuits 550 and 555, the operational amplifying circuits 560 and 565, and the respective functions thereof are similar to the embodiment shown in FIG. 2, and thus are not repeated again herein.

In comparison with the embodiment shown in FIG. 2, the pre-charge switch circuit 590 further includes a switch SW1 and a switch SW2, and the pre-charge switch circuit 595 further includes a switch SW3 and a switch SW4. The switch SW1 is electrically coupled to an odd data line for conducting the odd data line to the first pre-charge voltage VMH, and the switch SW2 is electrically coupled to the odd data line for conducting the odd data line to the second pre-charge voltage VML. Secondly, the switch SW3 is electrically coupled to an even data line for conducting the even data line to the first pre-charge voltage VMH, and the switch SW4 is electrically coupled to the even data line for conducting the even data line to the second pre-charge voltage VML.

Moreover, the transmission switch circuit 570 in the present embodiment further includes switches SW5, SW6, SW7 and SW8. The switch SW5 is electrically coupled to the odd data line for transmitting the first data signal OUT1 to the odd data line when being conducted. The switches SW7 and SW5 are connected in parallel, and are electrically coupled to the even data line for transmitting the first data signal OUT1 to the even data line when being conducted. The switch SW6 is electrically coupled to the odd data line for transmitting the second data signal OUT2 to the odd data line when being conducted. The switches SW8 and SW6 are connected in parallel, and are electrically coupled to the even data line for transmitting the second data signal OUT2 to the even data line when being conducted. The transmission switch circuit 570 and the pre-charge switch circuits 590 and 595 all are applicable to the source driver as shown in FIG. 2 or FIG. 3.

Figure 5B:
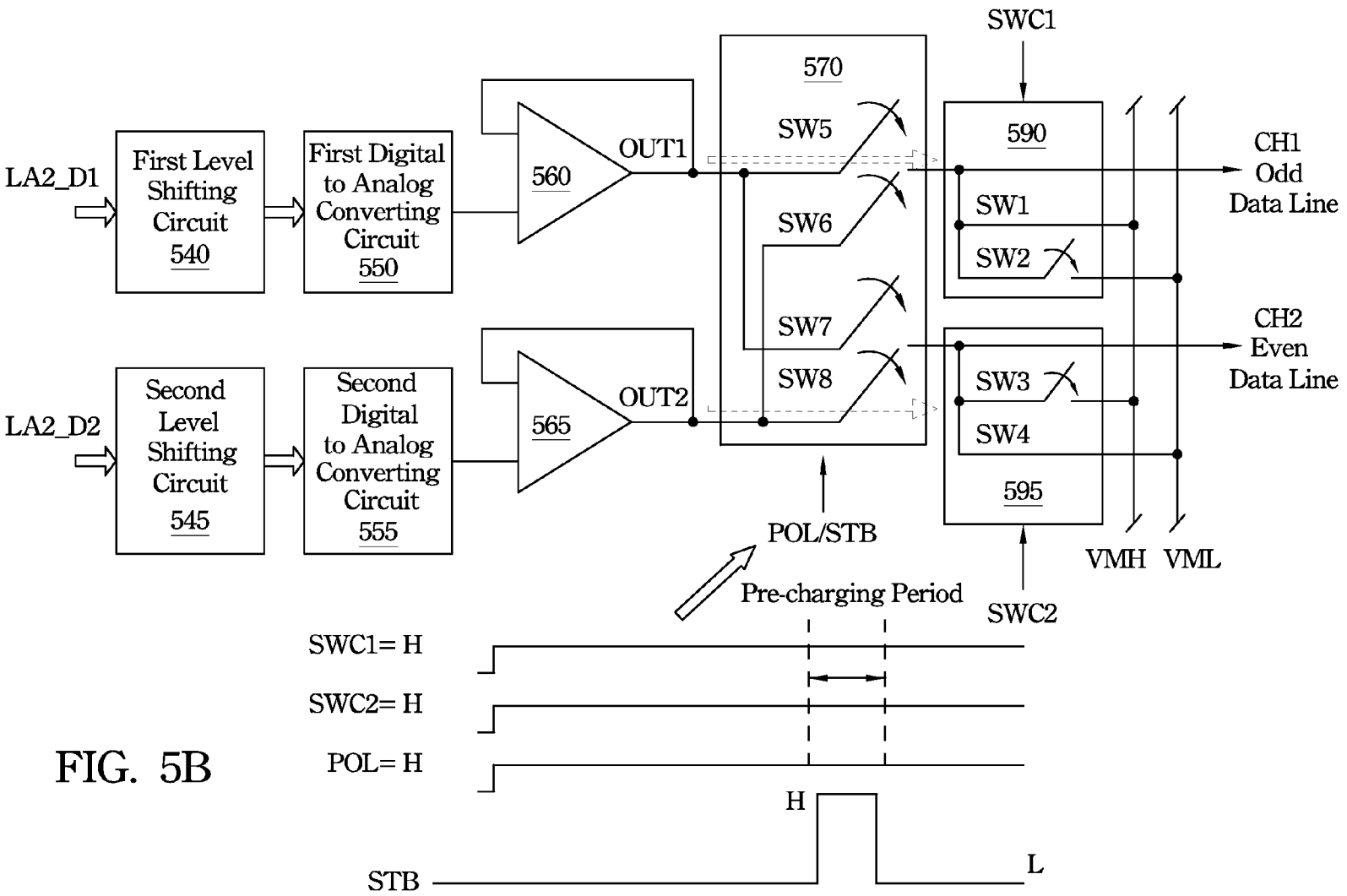
FIG. 5B and FIG. 5C are schematic diagrams showing the operation of the source driver shown in FIG. 5A according to the embodiment of the present disclosure.
Figure 5C:
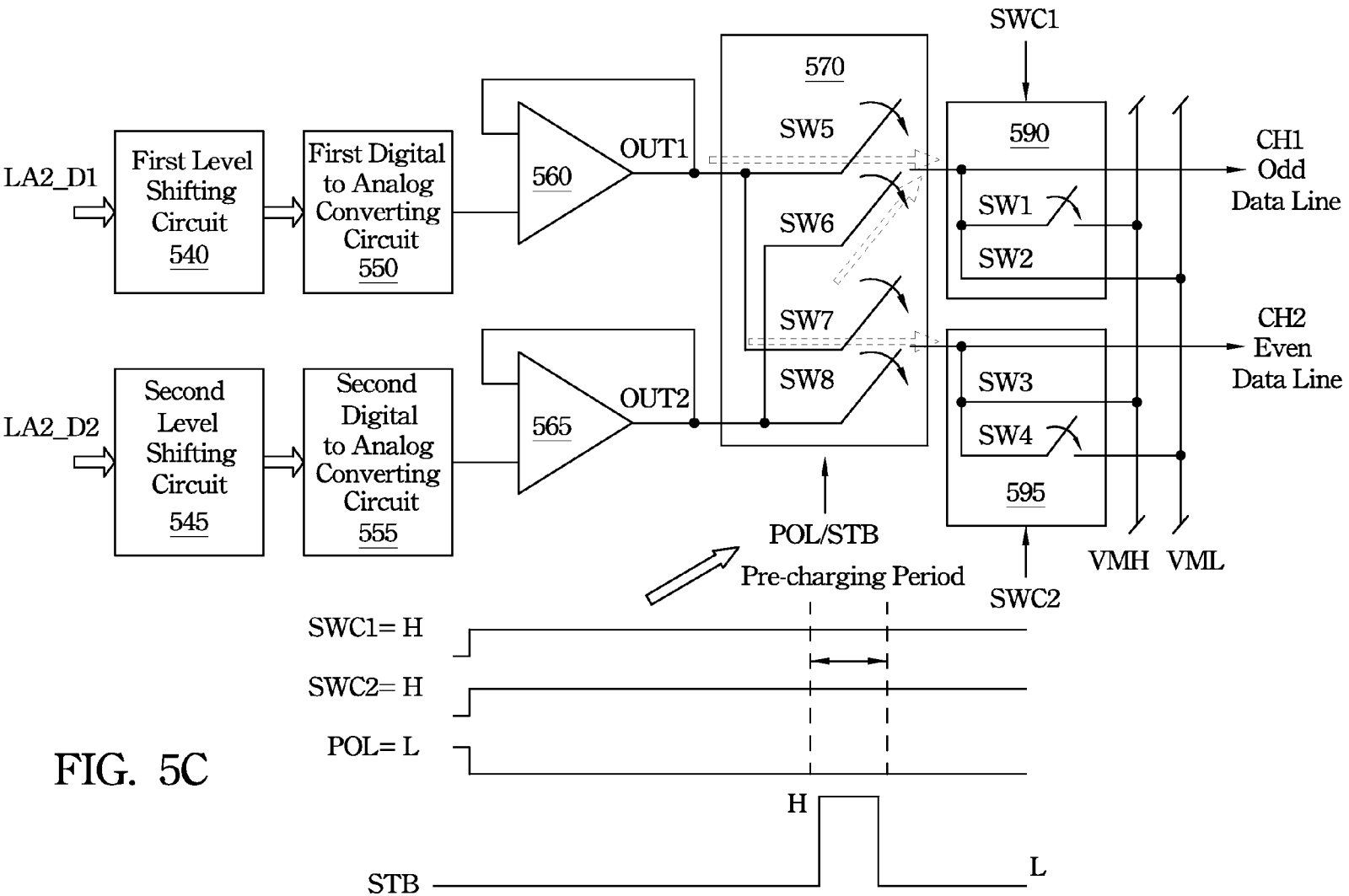

FIG. 5B and FIG. 5C are schematic diagrams showing the operation of the source driver shown in FIG. 5A according to the embodiment of the present disclosure. A shown in FIG. 5B, when the polarity signal POL is the high level (H) (for example, POL is a positive polarity signal) and the control signal STB is at the high level (H), the transmission switch circuit 570 is deactivated accordingly. Meanwhile, if the former and later input data are different to enable the switch control signals SWC1 and SWC2 to be at a high level (H), the switch SW1 is conducted in accordance the control signal SWC1 and the switch SW4 is conducted in accordance the control signal SWC2, such that the switch SW1 conducts the odd data line to the first pre-charge voltage VMH, and the switch SW4 conducts the even data line to the second pre-charge voltage VML, and the odd data line and the even data line are pre-charged respectively by the first pre-charge voltage VMH and the second pre-charge voltage VML when the control signal STB is being at the high level (H).

Thereafter, when the polarity signal POL is kept at the high level (H) and the control signal STB is changed to a low level (L), the switches SW1 and SW4 are turned off correspondingly, and the switches SW5 and SW8 are conducted correspondingly, such that the first output data signal OUT1 can be transmitted to the odd data line via the switch SW5 on the channel CH1 (i.e. the odd data line is charged again to a predetermined voltage level), and the second output data signal OUT2 can be transmitted to the even data line via the switch SW8 in the channel CH2 (i.e. the even data line is charged again to the predetermined voltage level).

On the other hand, as shown in FIG. 5C, when the polarity signal POL is at the low level (L) (for example, POL is a negative polarity signal) and the control signal STB is at the high level (H), the transmission switch circuit 570 is deactivated accordingly. Meanwhile, if the former and later input data are different to enable the switch control signals SWC1 and SWC2 to be at the high level (H), the switch SW2 is conducted in accordance the control signal SWC1 and the switch SW3 is conducted in accordance the control signal SWC2, such that the switch SW2 conducts the odd data line to the second pre-charge voltage VML, and the switch SW3 conducts the even data line to the first pre-charge voltage VMH, and the odd data line and the even data line are pre-charged respectively by the second pre-charge voltage VML and the first pre-charge voltage VMH when the control signal STB is being at the high level (H).

Thereafter, when the polarity signal POL is kept at the low level (L) and the control signal STB is changed to a low level (L), the switches SW2 and SW3 are turned off correspondingly, and the switches SW6 and SW7 are conducted correspondingly, such that the first output data signal OUT1 can be transmitted to the odd data line via the switch SW7 on the channel CH1 (i.e. the odd data line is charged again to a predetermined voltage level), and the second output data signal OUT2 can be transmitted to the even data line via the switch SW6 in the channel CH2 (i.e. the even data line is charged again to the predetermined voltage level).

Figure 6:
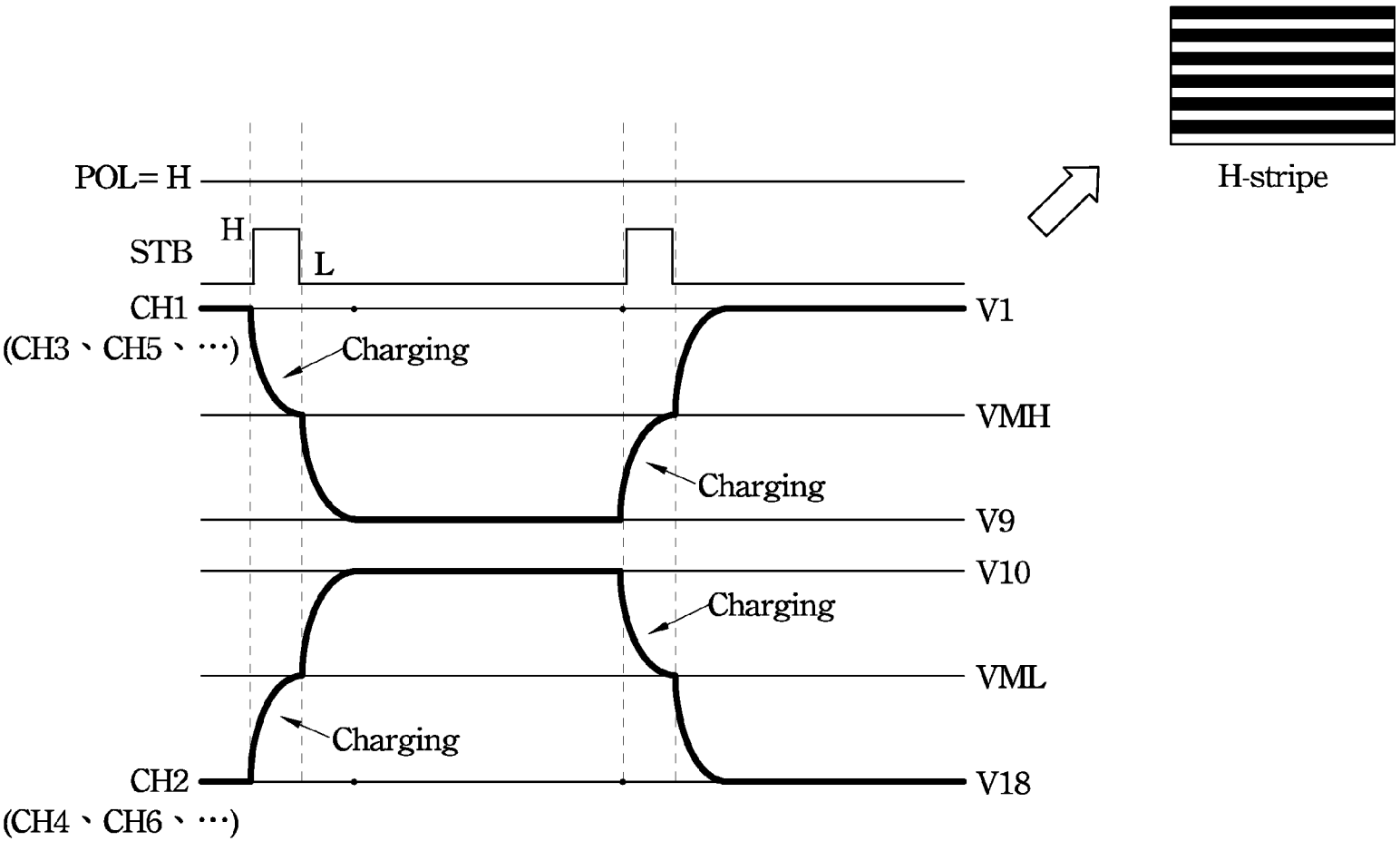
FIG. 6 is a schematic diagram showing signal changes on data lines when a H-stripe pixel pattern is displayed according to one embodiment of the present disclosure.

Hereinafter, an embodiment is used as an example for further explaining the operation of pre-charging the data line during data transition. FIG. 6 is a schematic diagram showing signal changes on data lines when a H-stripe pixel pattern is displayed according to one embodiment of the present disclosure. As shown in FIG. 6, under the situation of displaying the H-stripe pattern, when the polarity inversion method adopts column inversion, if the data signal corresponding the odd data line has positive polarity, then the data signals on the odd channels CH1, CH3, CH5, etc. performs positive polarity transitions (such as a transition between the positive polarity reference voltages V1 and V9); and if the data signal corresponding the even data line has positive polarity, then the data signals on the even channels CH2, CH4, CH6, etc. performs negative polarity transitions (such as a transition between the negative polarity reference voltages V10 and V18).

Please refer to FIG. 6, FIG. 5B and FIG. 5C. At first, when data transition occurs (i.e. the MSBs of the former and latter data signals are different), the transmission switch circuit 570 (such as the switches SW5, SW6, SW7 and SW8) is deactivated accordingly. Meanwhile, when the control signals are at the high level (H), the switches SW1 and SW4 are conducted respectively in accordance with the control signals SWC1 and SWC2, and the odd data line on the channel CH1 is pre-charged by the first pre-charge voltage VMH, and the even data line on the channel CH2 is pre-charged by the second pre-charge voltage VML, such that the odd data line originally with the voltage level V1 is discharged to the voltage level VMH, and the even data line originally with the voltage level V18 is re-charged to the voltage level VML.

Thereafter, when the control signal STB is lowered to the low level (L), the transmission switch circuit 570 is activated, and the switches SW1 and SW2 are turned off, and the odd data line on the channel CH1 and the even data line on the channel CH3 receive the corresponding output data signals OUT1 and OUT2 through the transmission switch circuit 570, such that the odd data line originally with the voltage level VMH is discharged to the predetermined voltage level V9, and the even data line originally with the voltage level VML is re-charged to the voltage level V10.

Then, when data transition occurs again, the transmission switch circuit 570 is de-activated again, and similarly, the odd data line on the channel CH1 is first pre-charged to the voltage level VMH, and the odd data line on the channel CH2 is first discharged to the voltage level VML. Thereafter, the transmission switch circuit 570 is activated again for re-charging the odd data line on the channel CH1 to the voltage level V1, and discharging the even data line on the channel CH2 to the voltage level V18 again. The subsequent operations are performed analogously.

It is worthy to be noted that in the aforementioned embodiment, although the pre-charging operation is performed when the control signal STB is at the high level (H), yet the present disclosure is not limited thereto. In other words, the aforementioned pre-charging operation also may be performed when the control signal STB is lowered to the low level (L). That is, as shown in FIG. 5B, when the control signal STB is at the low level (L), the transmission switch circuit 570 is de-activated, and the switch SW1 is conducted in accordance with the control signal SWC1, and the switch SW4 is conducted in accordance with the control signal SWC4, such that the odd data line and the even data line are pre-charged respectively by the first pre-charge voltage VMH and the second pre-charge voltage VML when the control signal STB is at the low level (L).

Hence, one of ordinary skill in the art may select appropriate periods for pre-charging operations in accordance with actual needs without departing the spirit and scope of the present disclosure.

By adopting the aforementioned operation methods, the data lines can be operated at a two-stage charging or discharging process and have the effect similar to charge sharing, thereby preventing the problem of elevated operation temperature caused by too much power consumption required by the source driver due to too large data voltage changes when data transition occurs.

Hence, the transition current required to be consumed can be reduced to lower the power required to be consumed by the source driver, thereby further lowering the operation temperature of the source driver, further effectively reducing the power consumption and operation temperature of the entire system.

Figure 7:
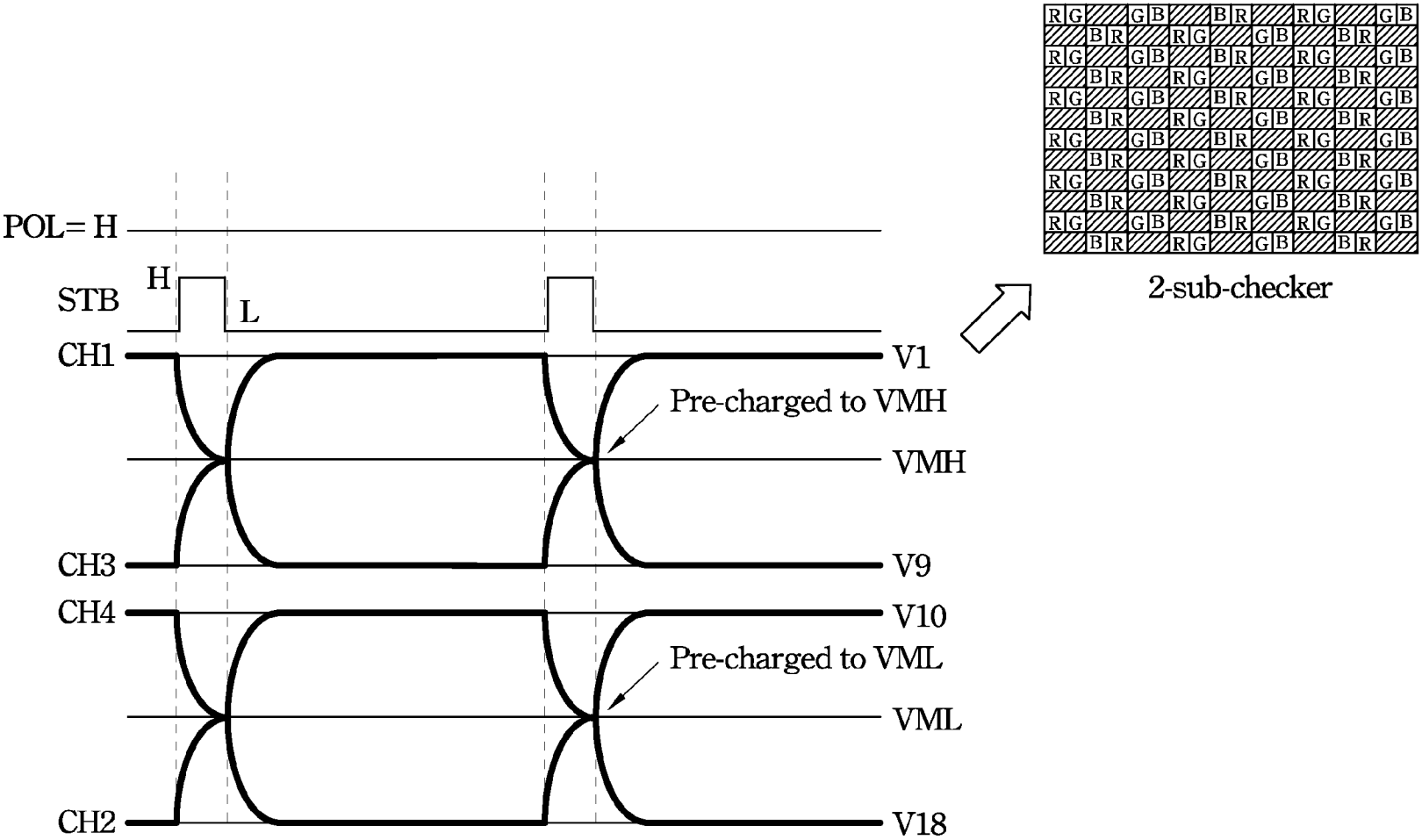
FIG. 7 is a schematic diagram showing signal changes on data lines when a 2-sub-checker pixel pattern is displayed according to one embodiment of the present disclosure.

FIG. 7 is a schematic diagram showing signal changes on data lines when a 2-sub-checker pixel pattern is displayed according to one embodiment of the present disclosure. As shown in FIG. 7, the data signals transmitted on the channels CH1 and CH3 perform positive polarity transitions (such as transitions between the positive polarity reference voltages V1 and V9), and the data signals transmitted on the channels CH2 and CH4 perform negative polarity transitions (such as transitions between the negative polarity reference voltages V1 and V9).

The operation method of the present disclosure is similar to that shown in FIG. 6. When the control signal STB is at the high level (H), the odd data line on the channels CH1 and CH3 are pre-charged to the voltage level VMH, and the even data lines on the channels CH2 and CH4 are pre-charged to the voltage level VML. Thereafter, when the control signal STB is lowered to the low level (L), the odd data lines on the channels CH1 and CH3 are then charged (or discharged) respectively to the predetermined voltage levels V9 and V1, and the even data lines on the channels CH2 and CH4 are then charged (or discharged) respectively to the predetermined voltage levels V1 and V18.

Similarly, the aforementioned pre-charging operations can also be performed when the control signal STB is lowered to the low level (L). That is, one of ordinary skill in the art may select appropriate periods for pre-charging operations in accordance with actual needs without departing the spirit and scope of the present disclosure.

By adopting the aforementioned operation methods, the data lines can be operated at a two-stage charging or discharging process and have the effect equivalent to charge sharing. Hence, the transition current required to be consumed can be reduced to lower the power required to be consumed by the source driver, thereby further lowering the operation temperature of the source driver, further effectively reducing the power consumption and operation temperature of the entire system.

On the other hand, besides the pre-charging scheme, the display panels of the aforementioned embodiments may further use the pre-charging and charge-sharing schemes at the same time, thereby saving the power consumption required by the source driver. Specifically speaking, in the embodiments shown in FIG. 2, FIG. 3 and FIG. 5A, each channel may further be coupled to a charge-sharing voltage via an additional switch for perform charge-sharing operation. Hereinafter, an embodiment is used as an example for further explaining the operation of simultaneously using the pre-charging and charge-sharing schemes.

Figure 8:
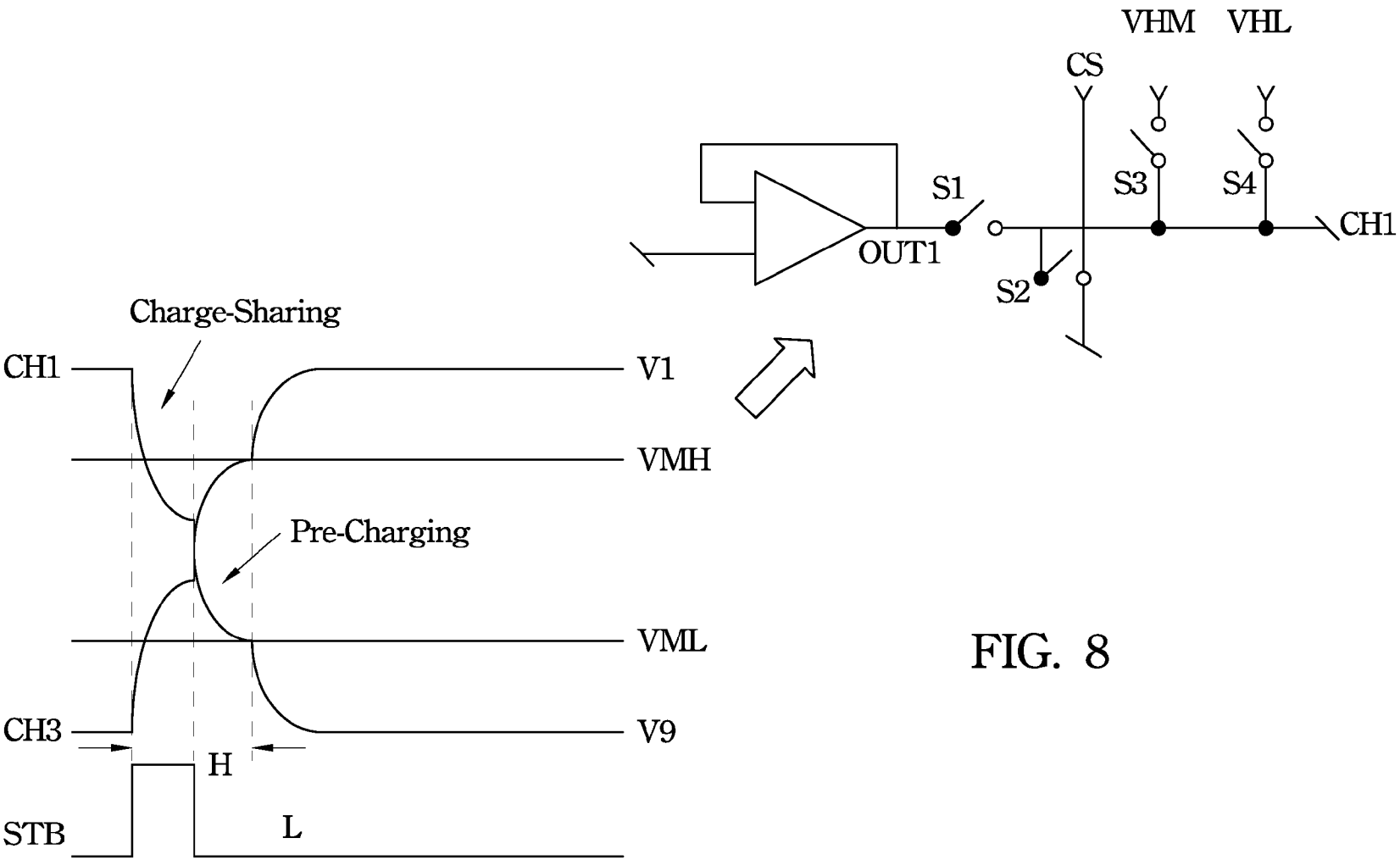
FIG. 8 is a schematic diagram showing signal changes on circuits and data lines to which pre-charging and charge-sharing schemes are applied according to one embodiment of the present disclosure.

FIG. 8 is a schematic diagram showing signal changes on circuits and data lines to which pre-charging and charge-sharing schemes are applied according to one embodiment of the present disclosure. As shown in FIG. 8, using the channel CH1 as an example, the data line on the channel Ch11 can be further coupled to a charge-sharing voltage CS via a switch S2 for performing charge-sharing operation before pre-charging. Specifically speaking, when the control signal STB is at the high level (H), switches S1, S3 and S4 are turned off, and the switch S2 is conducted, such that the data line on the channel CH1 is charged (or discharged) to the predetermined voltage V9 via the switch S1 in accordance with the output data signal OUT1. The data line on the channel CH3 performs a reverse operation and is charged (or discharged) to the predetermined voltage V1. The subsequent operations are performed analogously.

According to the above, by simultaneously using the pre-charging and charge-sharing schemes, the data lines can be operated in a three-stage charging (or discharging) process, thereby saving the power consumption required by the source driver and further effectively lowering the operation temperature of the source driver.

Figure 9:
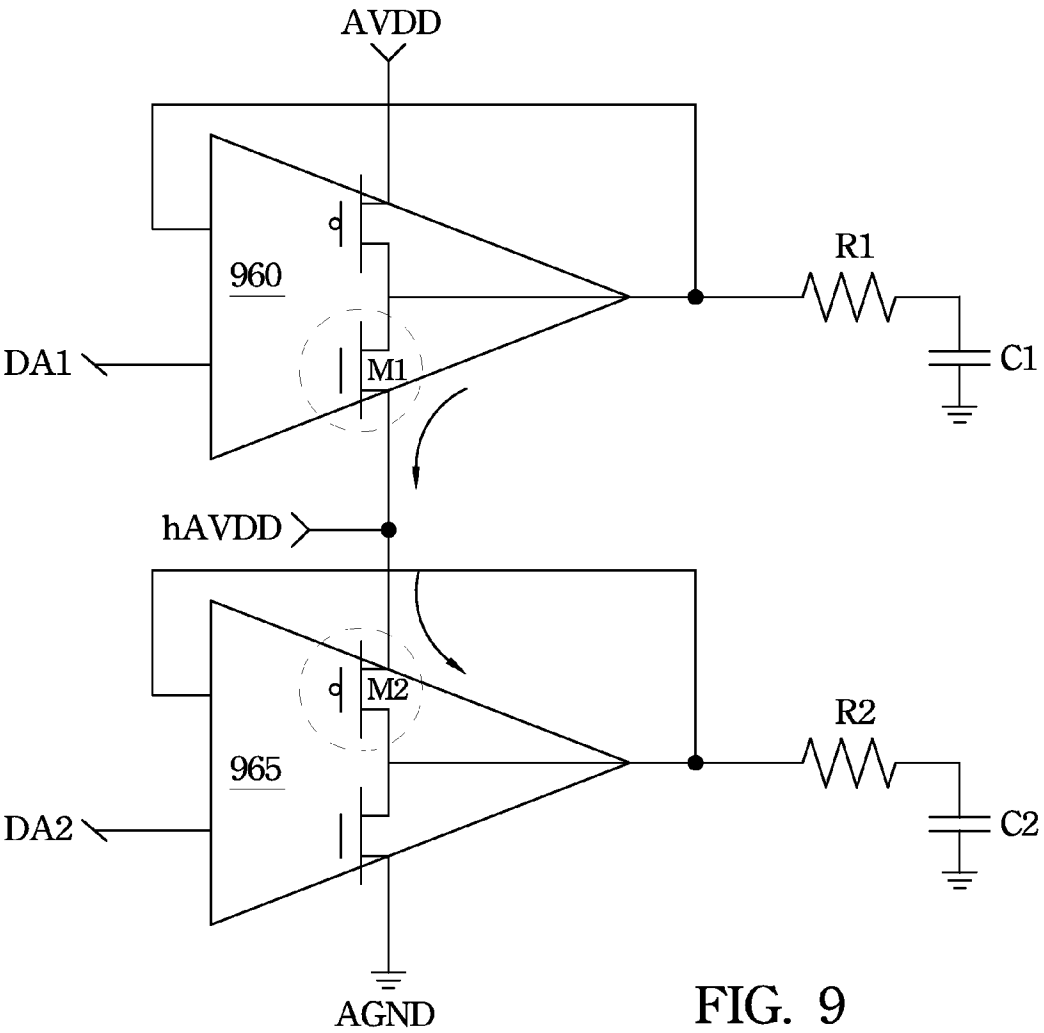
FIG. 9 is a schematic circuit diagram showing a source driver adopting a Half-AVDD structure according to one embodiment of the present disclosure.

Besides, the aforementioned source drivers as shown in FIG. 2, FIG. 3 and FIG. 5A may also adopt a Half-AVDD structure for lowering the power consumption and operation temperature of the entire system. FIG. 9 is a schematic circuit diagram showing a source driver adopting the Half-AVDD structure according to one embodiment of the present disclosure. Specifically speaking, as shown in FIG. 9, a first operational amplifying circuit 960 has a first input end and a second input end and a third input end, wherein the first input end is used for receiving a power source voltage AVDD, and the second input end is used for receiving a power source voltage hAVDD, and the third input end is used for receiving an analog signal DA1 (such as the analog signal outputted from the first digital to analog converting circuit), wherein the power source voltage AVDD is twice as much as the power source voltage hAVDD. Secondly, a second operational amplifying circuit 965 has a first input end and a second input end and a third input end, wherein the first input end is used for receiving a power source voltage hAVDD, and the second input end is used for receiving a ground voltage AGND, and the third input end is used for receiving an analog signal DA2 (such as the analog signal outputted from the second digital to analog converting circuit). The first operational amplifying circuit 960 and the second operational amplifying circuit 965 are applicable to the source drivers as shown in FIG. 2, FIG. 3 and FIG. 5A.

In operation, when the first operational amplifying circuit 960 outputs a positive polarity signal and the second operational amplifying circuit 965 outputs a negative polarity signal, the discharging current may flow to a negative polarity channel via a transistor M1 and a transistor M2, thereby charging the negative polarity channel. Thus, half of the static current can be saved when a specific pattern (such as a H-stripe pattern) is displayed.

Besides, since a current still flows through the transistors M1 and M2 when the aforementioned Half-AVDD structure is used, a portion of heat is still generated. Due to the size limitations of the transistors M1 and M2, the first operational amplifying circuit 960 and the second operational amplifying circuit 962 have relatively low slew rates of output signals. Thus, if the aforementioned pre-charging scheme is adopted, not only can the operation temperature be lowered, but also charging amplitudes of the signals outputted within a certain period of time by the first operational amplifying circuit 960 and the second operational amplifying circuit 962 with respect to the data lines can be further reduced, such that the response speeds of the first operational amplifying circuit 960 and the second operational amplifying circuit 962 can be enhanced.

In one embodiment, the aforementioned display panel further includes a voltage source disposed external to the source driver for providing the first pre-charge voltage VMH and the second pre-charge voltage VML to the source driver. Thus, the source driver may perform pre-charging operation through the external voltage source before the data signal is transmitted.

Figure 10A:
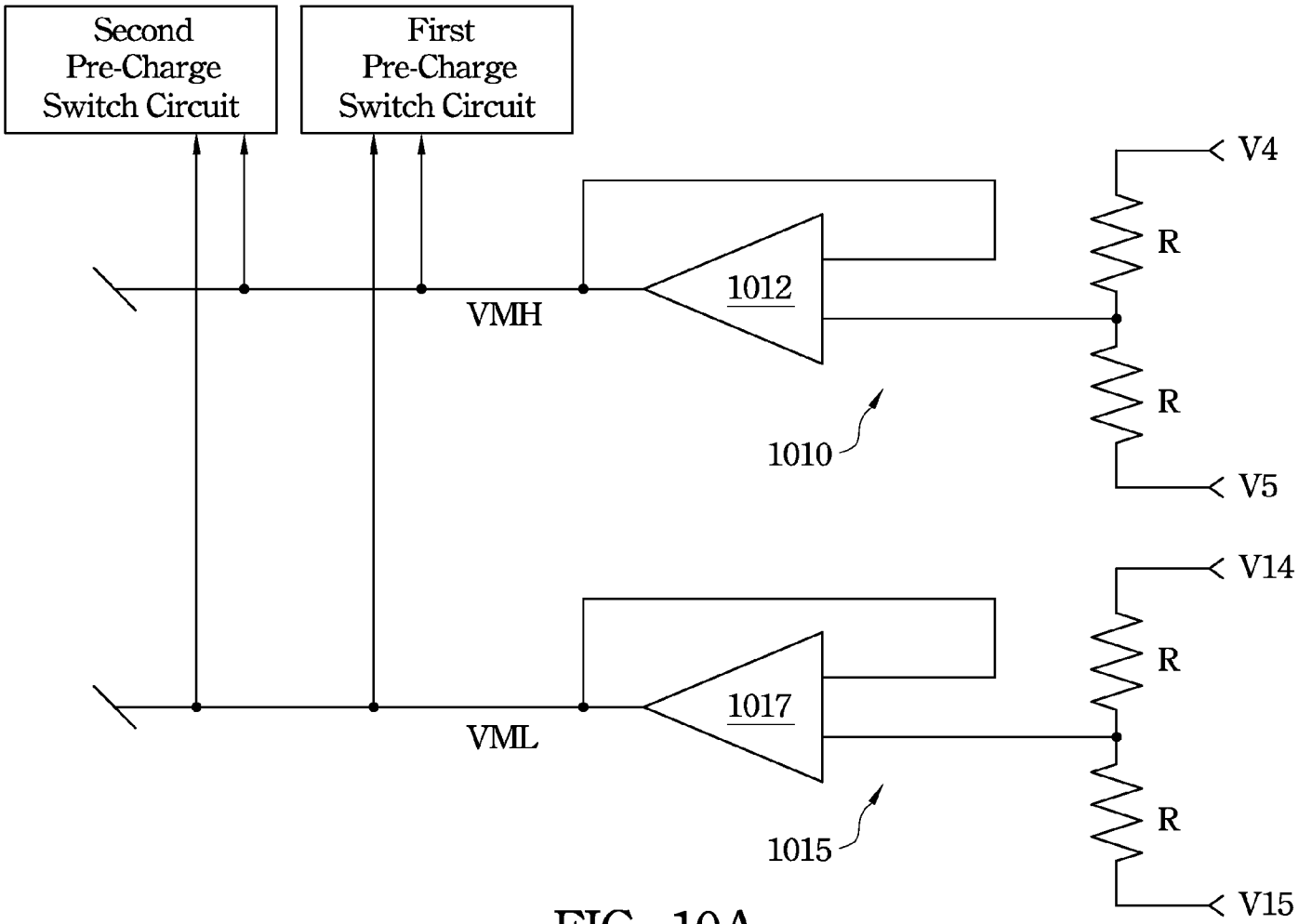
FIG. 10A is a schematic functional block diagram showing a circuit of voltage source in a display panel according to one embodiment of the present disclosure.

Specifically speaking, FIG. 10A is a schematic functional block diagram showing a circuit of voltage source in a display panel according to one embodiment of the present disclosure, wherein a first voltage source 1010 is electrically coupled to the first pre-charge switch circuit and the second pre-charge switch circuit, and is used for generating the first pre-charge voltage VMH; and a second voltage source 1015 is electrically coupled to the first pre-charge switch circuit and the second pre-charge switch circuit, and is used for generating the second pre-charge voltage VML.

As shown in FIG. 10A, the first voltage source 1010 includes an operational amplifying circuit 1012 and two resistors R connected in series, and the two resistors R are connected in series between a reference voltage V4 and a reference voltage V5. An output end of the operational amplifying circuit 1012 outputs the first pre-charge voltage VMH, and an input end of the operational amplifying circuit 1012 is coupled to the output end thereof. Another input end of the operational amplifying circuit 1012 is coupled to a connection point between the two resistors R, wherein the reference voltages V4 and V5 may be the positive polarity reference voltage provided in the positive polarity inversion period by the aforementioned digital to analog converting circuit. Secondly, the second voltage source 1015 includes an operational amplifying circuit 1017 and two resistors R connected in series, and the two resistors R are connected in series between a gamma voltage V14 and a gamma voltage V15. An output end of the operational amplifying circuit 1017 outputs the second pre-charge voltage VML, and an input end of the operational amplifying circuit 1017 is coupled to the output end thereof. Another input end of the operational amplifying circuit 1017 is coupled to a connection point between the two resistors R, wherein the gamma voltages V14 and V15 may be the negative polarity reference voltage provided in the negative polarity inversion period by the aforementioned digital to analog converting circuit. Accordingly, the pre-charge voltage VMH about equal to (V4+V5)/2 and the pre-charge voltage VML about equal to (V14+V15)/2 can be generated.

Figure 10B:
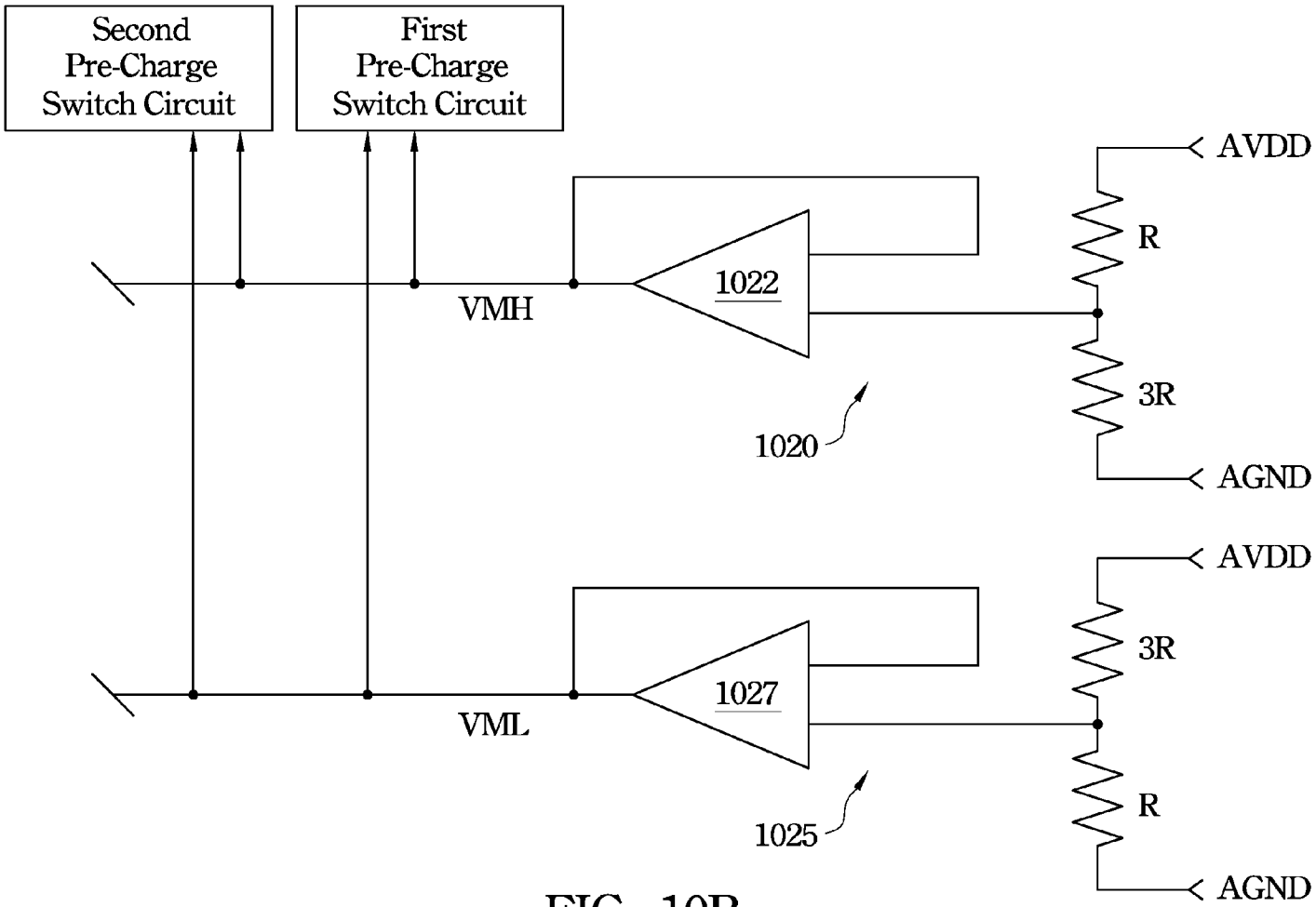
FIG. 10B is a schematic functional block diagram showing a circuit of voltage source in a display panel according to another embodiment of the present disclosure.

FIG. 10B is a schematic functional block diagram showing a circuit of voltage source in a display panel according to another embodiment of the present disclosure, wherein a first voltage source 1020 is electrically connected to the first pre-charge switch circuit and the second pre-charge switch circuit, and is used for generating the first pre-charge voltage VMH; and a second voltage source 1025 is electrically coupled to the first pre-charge switch circuit and the second pre-charge switch circuit, and is used for generating the second pre-charge voltage VML.

As shown in FIG. 10B, the first voltage source 1020 includes an operational amplifying circuit 1022 and two resistors R and 3R connected in series, and the two resistors R and 3R are connected in series between a power source voltage AVDD and a ground voltage AGND. An output end of the operational amplifying circuit 1022 outputs the first pre-charge voltage VMH, and an input end of the operational amplifying circuit 1022 is coupled to the output end thereof. Another input end of the operational amplifying circuit 1022 is coupled to a connection point between the two resistors R and 3R. Secondly, the second voltage source 1025 includes an operational amplifying circuit 1027 and two resistors R and 3R connected in series, and the two resistors R and 3R are connected in series between a power source voltage AVDD and a ground voltage AGND. An output end of the operational amplifying circuit 1017 outputs the second pre-charge voltage VML, and an input end of the operational amplifying circuit 1017 is coupled to the output end thereof. Another input end of the operational amplifying circuit 1027 is coupled to a connection point between the two resistors R and 3R. Accordingly, the pre-charge voltage VMH about equal to AVDD×¾ and the pre-charge voltage VML about equal to AVDD×¼ can be generated.

It is noted that the aforementioned pre-charge voltages VMH and VML are merely stated as examples for explanation. And do not intend to limit the present disclosure. One of ordinary skill in the art may select proper pre-charge voltages in accordance with actual needs.

Further, the circuit structure features of the source drivers in the aforementioned embodiments may be formed individually or collaboratively. For example, the source driver can be designed to the structure including the switch control circuit as shown in FIG. 4 and may also include the transmission switch circuit and the pre-charge switch circuits as shown in FIG. 5A at the same time. Hence, the aforementioned embodiments explain each feature one by one merely for description convenience, and all of the embodiments can collaborate with one another, and thus do not intend to limit the present disclosure.

Another technical aspect of the present disclosure is to provide a method for driving a display panel, and the method is applicable to the aforementioned embodiments regarding the source drivers. The display panel applicable to the method includes a plurality of data lines (such as the data lines D1-DN shown in FIG. 1) and a source driver (such as the source driver 120 shown in FIG. 1) used for driving the data lines. The data lines include a first data line and a second data line (such as the odd data line and the even data line shown in FIG. 2) adjacent to the first data line. The source driver includes a first latching circuit, a second latching circuit and a transmission switch circuit (such as the circuits 220, 230 and 270 shown in FIG. 2), wherein the first latching circuit is used for sequentially sampling input data signals and successively generating a first former sample data signal and a first latter sample data signal, and the second latching circuit is used for sequentially sampling the input data signals and successively generating a second former sample data signal and a second latter sample data signal, and the transmission switch circuit is activated in accordance with a polarity signal and a control signal (such as the polarity signal POL and the control signal STB), thereby transmitting a first output data signal corresponding to the first former sample data signal and a second output data signal corresponding to the second former sample data signal. The method includes the following steps.

In one step, the transmission switch circuit is deactivated in accordance with the polarity signal and the control signal. Thereafter, in another step, after the transmission switch circuit is deactivated, under a situation at which the MSB of the first former sample data signal is different from the MSB of the first latter sample data signal, the first data line is pre-charged by using one of a first pre-charge voltage and a second pre-charge voltage (the pre-charge voltages VMH and VML shown in FIG. 2) during a period in which the control signal is at a high level. Thereafter, in another step, under a situation at which the MSB of the second former sample data signal is different from the MSB of the second latter sample data signal, the second data line is pre-charged by using the other of the first pre-charge voltage and the second pre-charge voltage during the period in which the control signal is at the high level. The aforementioned first pre-charge voltage VMH can be grater than or about equal to the second pre-charge voltage VML. In other words, one of ordinary skill in the art may select proper voltages VMH and VML in accordance with actual needs.

In one embodiment, the aforementioned method further includes comparing the MSB of the first former sample data signal with the MSB of the first latter sample data signal; and comparing the MSB of the second former sample data signal with the MSB of the second latter sample data signal.

In another embodiment, when the aforementioned polarity signal is a positive polarity signal, the first data line is pre-charged by the first pre-charge voltage, and the second data line is pre-charged by the second pre-charge voltage.

In another embodiment, when the polarity signal is a negative polarity signal, the first data line is pre-charged by the second pre-charge voltage, and the second data line is pre-charged by the first pre-charge voltage.

In another embodiment, after the first data line and the second data line are pre-charges, the transmission switch circuit is activated, such that the first output data signal and the second output data signal are transmitted through the transmission switch circuit.

In another embodiment, the method further includes activating the transmission switch circuit after the first data line and the second data line pre-charges, thereby transmitting the first output data signal and the second output data signal to the first data line and the second data line through the transmission switch circuit.

unless being particularly specified, the sequence of the steps described in the embodiments unless being particularly specified may be adjusted in accordance with actual requirements, and even all or a portion of the steps therein may be executed simultaneously. The sequence of the aforementioned steps is not used for limiting the present disclosure.

According to the above, the embodiments of the present disclosure determine whether data transition occurs mainly by comparing the MSBs of the former and latter data, and pre-charge the data lines when data transition occurs, and then charge the data lines to the predetermined voltage level. Accordingly, not only can the data lines be operated at a two-stage charging (or discharging) process and have the effect similar or equivalent to charge sharing, thereby preventing the problem of elevated operation temperature caused by too much power consumption required by the source driver due to too large data voltage changes when data transition occurs, and further reducing the transition current required to be consumed and the power consumption of the source driver, thus lowering the operation temperature of the source driver.

Further, if the pre-charging and charge-sharing schemes are simultaneously adopted, the data lines can be operated in a three-stage charging (or discharging) process, thereby saving the power consumption required by the source driver and further effectively lowering the operation temperature of the source driver. Moreover, under the situation that the source driver adopting the Half-AVDD structure, if the aforementioned pre-charge scheme is adopted, the response speeds of the first operational amplifying circuits can be enhanced, and the signal slew rates can be increased.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the latter claims and their equivalents.

What is claimed is:

1. A display panel, comprising:

a plurality of data lines comprising a first data line and a second data line adjacent to the first data line; and a source driver coupled to the data lines, the source driver comprising:

a first latching circuit for sequentially sampling input data signals and successively generating a first former sample data signal and a first latter sample data signal, wherein the first latching circuit outputs the first former sample data signal when the first latter sample data signal is generated;

a second latching circuit for sequentially sampling the input data signals and successively generating a second former sample data signal and a second latter sample data signal, wherein the second latching circuit outputs the second former sample data signal when the second latter sample data signal is generated;

a transmission switch circuit coupled to the first data line and the second data line, wherein the transmission switch circuit is activated in accordance with a polarity signal and a control signal, such that a first output data signal corresponding to the first former sample data signal and a second output data signal corresponding to the second former sample data signal are transmitted through the transmission switch circuit;

a switch control circuit coupled to the first latching circuit and the second latching circuit for comparing the most significant bit (MSB) of the first former sample data signal with the MSB of the first latter sample data signal and comparing the MSB of the second former sample data signal with the MSB of the second latter sample data signal, thereby generating a first switch control signal and a second switch control signal;

a first pre-charge switch circuit coupled to the first data line and the switch control circuit, wherein the first pre-charge switch circuit is activated in accordance with the first switch control signal, the polarity signal and the control signal when the transmission switch circuit is deactivated, such that the first data line is pre-charged by one of a first pre-charge voltage and a second pre-charge voltage through the first pre-charge switch circuit; and a second pre-charge switch circuit coupled to the second data line and the switch control circuit, wherein the second pre-charge switch circuit is activated in accordance with the second switch control signal, the polarity signal and the control signal when the transmission switch circuit is deactivated, such that the second data line is pre-charged by the other of the first pre-charge voltage and the second pre-charge voltage through the second pre-charge switch circuit.

2. The display panel as claimed in claim 1, wherein the switch control circuit further comprises:

a first multiplexing circuit having a first input end, a second input end, a first output end and a second output end, wherein the first input end of the first multiplexing circuit is used for receiving the MSB of the first latter sample data signal, and the second input end of the first multiplexing circuit is used for receiving the MSB of the second latter sample data signal;

a second multiplexing circuit having a first input end, a second input end, a first output end and a second output end, wherein the first input end of the second multiplexing circuit is used for receiving the MSB of the first former sample data signal, and the second input end of the second multiplexing circuit is used for receiving the MSB of the second former sample data signal;

a first XOR gate having a first input end, a second input end and an output end, wherein the first input end of the first XOR gate is coupled to the first output end of the first multiplexing circuit, and the second input end of the first XOR gate is coupled to the first output end of the second multiplexing circuit, and the output end of the first XOR gate is used for outputting a first comparison signal; and a second XOR gate having a first input end, a second input end and an output end, wherein the first input end of the second XOR gate is coupled to the second output end of the first multiplexing circuit, and the second input end of the second XOR gate is coupled to the second output end of the second multiplexing circuit, and the output end of the second XOR gate is used for outputting a second comparison signal.

3. The display panel as claimed in claim 2, wherein the switch control circuit further comprises:

a first D-type flip-flop for receiving the first comparison signal and outputting the first comparison signal after being triggered by the control signal;

a first level shifter for processing the first comparison signal outputted by the first D-type flip-flop so as to output the first switch control signal;

a second D-type flip-flop for receiving the second comparison signal and outputting the second comparison signal after being triggered by the control signal;

a second level shifter for processing the second comparison signal outputted by the second D-type flip-flop so as to output the first switch control signal.

4. The display panel as claimed in claim 1, wherein the first pre-charge switch circuit further comprises:

a first switch coupled to the first data line for conducting the first data line to the first pre-charge voltage; and a second switch which is coupled to the first data line and is connected in series with the first switch for conducting the first data line to the second pre-charge voltage; and the second pre-charge switch circuit further comprises:

a third switch coupled to the second data line for conducting the second data line to the first pre-charge voltage; and a fourth switch which is coupled to the second data line and is connected in series with the first switch for conducting the second data line to the second pre-charge voltage.

5. The display panel as claimed in claim 4, wherein the transmission switch circuit further comprises:

a fifth switch coupled to the first data line for transmitting the first output data signal to the first data line when being conducted;

a sixth switch which is connected in series with the fifth switch and is coupled to the second data line for transmitting the first output data signal to the second data line when being conducted;

a seventh switch coupled to the first data line for transmitting the second output data signal to the first data line when being conducted; and an eighth switch which is connected in series with the seventh switch and is coupled to the second data line for transmitting the second output data signal to the second data line when being conducted.

6. The display panel as claimed in claim 1, wherein the first latching circuit further comprises:

a first latching unit for outputting the first latter sample data signal;

a first multiplexing unit having a first input end and a second input end, wherein the first input end of the first multiplexing unit is coupled to an output end of the first latching unit; and a second latching unit coupled to an output end of the first multiplexing unit for outputting the first former sample data signal; and the second latching circuit further comprises:

a third latching unit for outputting the second latter sample data signal;

a second multiplexing unit having a first input end and a second input end, wherein the first input end of the second multiplexing unit is coupled to an output end of the third latching unit; and a fourth latching unit coupled to an output end of the second multiplexing unit for outputting the second former sample data signal;

wherein the second input end of the first multiplexing unit is coupled to the output end of the third latching unit, and the second input end of the second multiplexing unit is coupled to the output end of the first latching unit.

7. The display panel as claimed in claim 1, wherein the source driver further comprises:

a first level shifting circuit for receiving the first former sample data signal outputted by the first latching circuit and outputting a first level shifted data signal;

a second level shifting circuit for receiving the second former sample data signal outputted by the second latching circuit and outputting a second level shifted data signal;

a first digital to analog converting circuit for converting the first level shifted data signal to a first analog signal;

a second digital to analog converting circuit for converting the second level shifted data signal to a second analog signal;

a first operational amplifying circuit for processing the first analog signal to generate the first output data signal; and a second operational amplifying circuit for processing the second analog signal to generate the second output data signal.

8. The display panel as claimed in claim 7, wherein the first operational amplifying circuit has a first input end for receiving a first power source voltage, a second input end for receiving a second power source voltage, and a third input end for receiving the first analog signal, wherein the first power source voltage is twice as much as the second power source voltage; and the second operational amplifying circuit has a first input end for receiving a second power source voltage, a second input end for receiving a ground voltage, and a third input end for receiving the second analog signal.

9. The display panel as claimed in claim 1, further comprising:

a first voltage source coupled to the first pre-charge switch circuit and the second pre-charge switch circuit for generating the first pre-charge voltage; and to a second voltage source coupled to the first pre-charge switch circuit and the second pre-charge switch circuit for generating the second pre-charge voltage.

10. The display panel as claimed in claim 1, wherein during a period in which the control signal is at a high level, when the polarity signal is a positive polarity signal, the first data line is pre-charged by the first pre-charge voltage through the first pre-charge switch circuit, and the second data line is pre-charged by the second pre-charge voltage through the second pre-charge switch circuit.

11. The display panel as claimed in claim 1, wherein during a period in which the control signal is at a high level, when the polarity signal is a negative polarity signal, the first data line is pre-charged by the second pre-charge voltage through the first pre-charge switch circuit, and the second data line is pre-charged by the first pre-charge voltage through the second pre-charge switch circuit.

12. A method for driving a display panel, the display panel comprising a plurality of data lines and a source driver used for driving the data lines, the data lines comprising a first data line and a second data line adjacent to the first data line, the source driver comprising a first latching circuit, a second latching circuit and a transmission switch circuit, wherein the first latching circuit is used for sequentially sampling input data signals and successively generating a first former sample data signal and a first latter sample data signal, and the second latching circuit is used for sequentially sampling the input data signals and successively generating a second former sample data signal and a second latter sample data signal, and the transmission switch circuit is activated in accordance with a polarity signal and a control signal, thereby transmitting a first output data signal corresponding to the first former sample data signal and a second output data signal corresponding to the second former sample data signal, the method comprising:

deactivating the transmission switch circuit in accordance with the polarity signal and the control signal;

under a situation at which the most significant bit (MSB) of the first former sample data signal is different from the MSB of the first latter sample data signal, pre-charging the first data line by using one of a first pre-charge voltage and a second pre-charge voltage during a period in which the control signal is at a high level; and under a situation at which the MSB of the second former sample data signal is different from the MSB of the second latter sample data signal, pre-charging the second data line by using the other of the first pre-charge voltage and the second pre-charge voltage during the period in which the control signal is at the high level.

13. The method as claimed in claim 12, wherein, when the polarity signal is a positive polarity signal, the first data line is pre-charged by the first pre-charge voltage through the first pre-charge switch circuit, and the second data line is pre-charged by the second pre-charge voltage through the second pre-charge switch circuit.

14. The method as claimed in claim 12, wherein, when the polarity signal is a negative polarity signal, the first data line is pre-charged by the second pre-charge voltage through the first pre-charge switch circuit, and the second data line is pre-charged by the first pre-charge voltage through the second pre-charge switch circuit.

15. The method as claimed in claim 12, further comprising:

activating the transmission switch circuit after the first data line and the second data line pre-charges, thereby transmitting the first output data signal and the second output data signal to the first data line and the second data line through the transmission switch circuit.

* * * * *